US005978639A

United States Patent [19]

Masuda et al.

[11] Patent Number: 5,978,639

[45] Date of Patent: Nov. 2, 1999

[54] INTERMEDIATE TRANSFER MEMBER AND INTERMEDIATE TRANSFER DEVICE

[75] Inventors: Yoshitomo Masuda, Hamura; Yuko Maeda, Hino; Norihiko Kaga, Kodaira; Hideyuki Niwa, Sayama; Chikara Yamada, Kodaira; Takashi Kitamura, Musashimurayama; Takahiro Kawagoe, Tokorozawa, all of Japan

[73] Assignee: Bridgestone Corporation, Tokyo, Japan

[21] Appl. No.: 09/071,536

[22] Filed: May 4, 1998

[30] Foreign Application Priority Data

| | | | |
|---|---|---|---|
| May 2, 1997 | [JP] | Japan | 9-130473 |
| May 2, 1997 | [JP] | Japan | 9-130474 |
| May 16, 1997 | [JP] | Japan | 9-143578 |
| May 26, 1997 | [JP] | Japan | 9-151612 |
| May 28, 1997 | [JP] | Japan | 9-154447 |
| Jun. 24, 1997 | [JP] | Japan | 9-183035 |
| Jul. 29, 1997 | [JP] | Japan | 9-218172 |
| Dec. 22, 1997 | [JP] | Japan | 9-365546 |

[51] Int. Cl.[6] ..... G03G 15/16

[52] U.S. Cl. ..... 399/302; 399/308

[58] Field of Search ..... 399/308, 302, 399/297; 430/126; 428/195, 914; 492/18, 25, 53, 56

[56] References Cited

U.S. PATENT DOCUMENTS

| | | | |
|---|---|---|---|
| 5,669,052 | 9/1997 | Kusaba et al. | 399/308 |
| 5,689,754 | 11/1997 | Yoshida et al. | 399/1 |
| 5,752,130 | 5/1998 | Tanaka et al. | 399/308 X |
| 5,809,373 | 9/1998 | Yoda et al. | 399/101 |

FOREIGN PATENT DOCUMENTS 8-157556 6/1996 Japan .

*Primary Examiner*—Matthew S. Smith
*Assistant Examiner*—Sophia S. Chen
*Attorney, Agent, or Firm*—Sughrue, Mion, Zinn, Macpeak & Seas, PLLC

[57] ABSTRACT

Disclosed is an intermediate transfer member disposed between an image forming body and a recording medium, for transferring and holding a toner image formed on a surface of the image forming body onto a surface of the intermediate transfer member once and then transferring the toner image onto the recording medium, the intermediate transfer member including: a rubber composition, wherein the state of occurrence of cracks in the rubber composition after the rubber composition imparted with 20% of elongation has been exposed for 120 hours to an environment with an ozone concentration of 10 ppm and with a temperature of 40° C. is specified such that no crack is seen, or the number of cracks and the depth of cracks satisfy a specific evaluation standard.

35 Claims, 6 Drawing Sheets

1 INVENTIVE EXAMPLE 20
2 INVENTIVE EXAMPLE 21
3 INVENTIVE EXAMPLE 22
4 INVENTIVE EXAMPLE 23
5 COMPARATIVE EXAMPLE 11
6 COMPARATIVE EXAMPLE 12

INTERMEDIATE TRANSFER MEMBER AND INTERMEDIATE TRANSFER DEVICE

BACKGROUND OF THE INVENTION

The present invention relates to an intermediate transfer member used for an electrophotographic device or electrostatic recording device such as a copying machine or printer, wherein a toner image, which is formed by supplying a developer on the surface of an image forming member such as a latent image holder holding an electrostatic latent image, is once transferred and held on the surface of the intermediate transfer member and is then transferred on a recording medium such as a paper sheet; and an intermediate transfer device using the intermediate transfer member.

In an electrostatic recording process using a copying machine, printer or the like, there has been adopted a printing method including the steps of uniformly electrifying the surface of a photosensitive body (latent image holder), forming an electrostatic latent image on the photosensitive body by projecting light from an optical system on the photosensitive body to erase electrification of a portion where the light is irradiated, supplying a toner to the electrostatic latent image by a developing means such as a developing roller to form a toner image by electrostatic adhesion of the toner, transferring the toner image on a recording medium such as a paper sheet by a transferring means such as a transfer roller, and heating and fixing the transferred image on the recording medium by a fixing means such a fixing roller, to thus obtain a printed image.

In a color printer or a color copying machine, printing is basically performed in accordance with the above process; however, in the case of color printing, a color tone is reproduced using four kinds of toners corresponding to four colors (magenta, yellow, cyan and black), and consequently, there are required steps of obtaining a necessary color tone by superimposing these toners at a specific ratio. To achieve these steps, there have been proposed various methods.

As a first method, there is known a multiple developing method in which, to visualize an electrostatic latent image formed on a photosensitive body by supplying toners, development is performed by sequentially superimposing toners of four colors (magenta, yellow, cyan and black) to form a color toner image on the photosensitive body. This method allows the printing apparatus to be made relatively compact; however, it is disadvantageous in that control of color gradation is very difficult and thereby a high quality image cannot be obtained.

As a second method, there is known a tandem method using four photosensitive bodies aligned in a line. In this method, latent images formed on these photosensitive bodies are developed using toners of four colors (magenta, yellow, cyan and black) to form four toner images (magenta toner image, yellow toner image, cyan toner image, and black toner image), and the toner images are sequentially transferred on a recording medium such as a paper sheet in a superimposing manner, thereby reproducing a color image thereon. This method is advantageous in that a desirable image can be obtained; however, it is disadvantageous in that the printing apparatus has the four photosensitive bodies aligned in line, each being additionally provided with an electrifying mechanism and a developing mechanism and thereby it is enlarged in size and also increased in cost.

As a third method, there is known a transfer drum method using a transfer drum around which a recording medium such as a paper sheet is wound. Such a transfer drum revolves on its axis four times, and toner images of four colors (magenta, yellow, cyan, and black) formed on photosensitive bodies are sequentially transferred on the recording medium for each revolution of the transfer drum, to thereby reproduce a color image thereon. This method is advantageous in that a relatively high quality image can be obtained; however, it is disadvantageous in that there is a difficulty in winding a thick medium such as a post card, that is, there is a limitation to the kind of the recording medium.

In addition to the above multiple developing method, tandem method, and transfer drum method, there has been proposed an intermediate transfer method for ensuring a high quality image without enlargement of the size of the apparatus and also without limitation to the kind of the recording medium.

The intermediate transfer method adopts an intermediate transfer member formed into a drum or belt-like shape on which a toner image on a photosensitive body is transferred and held thereon once. To be more specific, the intermediate transfer method is carried out by forming toner images of four colors (magenta, yellow, cyan, and black) on four photosensitive bodies, sequentially transferring the four toner images from the four photosensitive bodies onto the surface of the intermediate transfer member to form a color image on the intermediate transfer member, and transferring the color image on a recording medium such as a paper sheet. In this method, since color gradation is adjusted by superimposing toner images of four colors, a high quality image can be obtained. Also, since the photosensitive bodies are not required to be aligned in a line like the tandem method, the size of the apparatus is not enlarged. Further, since a recording medium is not required to be wound around a drum, there is no limitation to the kind of the recording medium.

Such an image forming apparatus for forming a color image by the intermediate transfer method is shown in FIGS. 1 and 2, wherein FIG. 1 shows a type using a drum-like intermediate transfer member, and FIG. 2 shows a type using a belt-like intermediate transfer member.

Referring to FIGS. 1 and 2, reference numeral 1 indicates a drum-like photosensitive body which revolves in the direction shown by an arrow. The photosensitive body 1 is electrified by a primary electrifier 2, and is subjected to image exposure 3 for erasing electrification of an exposed portion. Thus, an electrostatic latent image corresponding to a first color component is formed on the photosensitive body 1. The electrostatic latent image is then developed with a magenta toner M as a first color toner using a developer 41 to form a magenta toner image as a first color image on the photosensitive body 1. The toner image is transferred on an intermediate transfer drum 20*a* (FIG. 1) or an intermediate transfer belt 20*b* (FIG. 2) (hereinafter, referred to as "an intermediate transfer member 20*a* or 20*b*") rotating in a state being in contact with the photosensitive body 1. In this case, the transfer of the image from the photosensitive body 1 to the intermediate transfer member 20*a* or 20*b* is performed by applying a primary transfer bias from a power supply 61 to the intermediate transfer member 20*a* or 20*b* at a nip portion between the photosensitive body 1 and the intermediate transfer member 20*a* or 20*b*. After the magenta toner image as the first color image is transferred on the intermediate transfer member 20*a* or 20*b*, the surface of the photosensitive body 1 is cleaned using a cleaning device 14. The first development/transfer operation by the initial rotation of the photosensitive body 1 is thus completed. Thereafter, the photosensitive body revolves on its axis three times, and a cyan toner image as a second color image, a yellow toner image as a third color image, and a black toner image as a fourth color image are sequentially formed on the photosensitive body 1 using developers 42, 43 and 44 for each revolution of the photosensitive body 1. The four toner images are sequentially transferred on the intermediate transfer member 20*a* or 20*b* in a superimposing manner for each revolution, to form a synthetic color toner image corresponding to the target color image on the intermediate transfer member 20*a* or 20*b*. It is to be noted that in the apparatus shown in FIG. 1, the developers 41 to 44 are sequentially exchanged for each revolution of the photosensitive body 1 to sequentially perform development by the magenta toner M, cyan toner C, yellow toner Y, and black toner B.

Next, a transfer roller 25 is abutted on the intermediate transfer member 20*a* or 20*b* on which the above synthetic color toner image is formed, and a recording medium 24 such as a paper sheet is fed from a paper cassette 9 into a nip portion therebetween. At the same time, a second transfer bias is applied from a power supply 29 to the transfer roller 25 so that the synthetic color image is transferred from the intermediate transfer member 20*a* or 20*b* to the recording medium 24 and is thermally fixed, by a fixing device 15, thereon as the final image. After the synthetic color image is transferred to the recording medium 24, the toner remaining on the surface of the intermediate transfer member 20*a* or 20*b* is removed by the cleaning device 35, and thereby the intermediate transfer member 20*a* or 20*b* is returned to the initial state to ready for the next image formation.

Such an intermediate transfer member 20*a* or 20*b* used for the intermediate transfer type image forming apparatus, which is in direct-contact with the photosensitive body 1, toner image, recording medium 24 and the like, is made from a soft elastic material. Further, in the case of the intermediate transfer member 20 a formed into the drum-like shape shown in FIG. 1, it is known that a conductive rubber-like elastic body 201 is laminated on a metal made drum base 200; and in the case of the intermediate transfer member 20*b* formed into the belt-like shape shown in FIG. 2, it has been known that a conductive rubber-like elastic body 201 reinforced by a canvass or a spirally wound thread (not shown) is formed into a belt-shape as shown in FIG. 4. As shown in FIGS. 3 and 4, there has been proposed a technique in which a surface layer 202 made from a resin is formed on a surface of the rubber-like elastic body 201 for preventing contamination of the photosensitive body, preventing adhesion of toner, and reducing a friction coefficient.

Incidentally, in the electrophotographic process or electrostatic recording process using such an image forming apparatus, ozone at a high concentration is produced in the electrifying and transfer steps, and accordingly, each of members constituting the image forming apparatus requires a high durability to ozone.

In the case of the above-described intermediate transfer member, however, it has been not apparent how the intermediate transfer member should be tested to judge whether or not the intermediate transfer member has a sufficient durability to ozone or it has been not apparent what kind of material should be used for the intermediate transfer member to ensure a sufficient durability to ozone.

Thus, a measure to shield members from ozone by covering the members with a metal material has been made; however, such a measure leads to the increased cost, and further a power supplying condition of the image forming apparatus has been restricted to suppress occurrence of ozone, causing a problem in design of the apparatus.

The intermediate transfer member might be also exposed to a high temperature upon fixing of an image, resulting in the thermal deterioration together with the above-described deterioration due to ozone. In particular, a rubber material used for an elastic layer is severely deteriorated due to these heat and ozone effects, and to cope with such an inconvenience, the rubber material has been added with an ozone-deterioration preventive agent and a thermal aging preventive agent.

The addition of an ozone-deterioration preventive agent and a thermal aging preventive agent in a rubber material, however, may contaminate a photosensitive body, toner, a paper sheet and the like, with a result that image formation becomes defective. To prevent such contamination, the above surface layer made from a resin has been formed on an elastic layer made from a rubber material. In this case, however, to ensure a sufficient contamination preventive effect, a surface layer having a relatively large thickness of several tens to several hundreds $\mu$m must be formed, and the formation of such a thick surface layer makes higher a surface hardness of the intermediate transfer member. This presents problems in causing wear of a photosensitive body in contact with the member and fusion of toner.

The intermediate transfer member also requires a resistivity in a medium resistivity range of $10^8$ to $10^{14}$ Ωcm for applying a suitable vias voltage to an objected to be applied with a voltage such as toner or a paper sheet without occurrence of leakage and also breakage of a member due to the voltage. In this case, for an intermediate transfer member having a surface layer, the resistivity of the member becomes generally higher by the presence of the surface layer, and consequently, an elastic layer of the member requires a volume resistivity lower than that of an elastic layer of a member having no surface layer, more specifically, a volume resistivity in a semi-conductive range of $10^4$ to $10^9$ Ωcm.

However, it is very difficult to control a volume resistivity of a rubber material for an elastic layer in the above semi-conductive range. That is, it is extremely difficult to obtain a specific volume resistivity by addition a general conductive carbon material in a usual rubber material, so that there occur large variations in resistivity among and in each of elastic layers of intermediate transfer members obtained. This makes it difficult to stably obtain a member having an elastic layer having a uniform resistivity. On the basis of a graph (called percolation curve) obtained for rubber compositions whose volume resistivities are adjusted by addition of carbon, in which the abscissa indicates added amounts of carbon and the ordinate indicates volume resistivities of the rubber compositions, the volume resistivity is rapidly dropped at a specific added amount of carbon, and then kept constant. From this percolation curve, it becomes apparent that the variation in volume resistivity of a rubber composition is due to the rapid change in the percolation curve.

Accordingly, it is expected to develop an intermediate transfer member which is excellent in resistance to ozone and heat resistance,, and which is capable of stably exhibiting a preferable performance for a long period, of relatively easily adjusting a resistivity, and of reducing a variation in resistivity.

On the other hand, in the case where the surface layer 202 formed on the surface of the above intermediate transfer member is made from a resin material, the surface layer 202 may be peeled from the rubber-like elastic layer 201 or cracked because a resin material is generally harder than a rubber material and is difficult to follow elastic deformation of the rubber material. In this case, it may be considered to use a soft resin material; however, the soft resin material cannot be actually used for the surface layer 202 of the intermediate transfer member because the soft resin material is large in plastic deformation and also large in viscosity and friction coefficient. Besides, a urethane resin having a specific composition can preferably follow elastic deformation of a rubber material, and it has been proposed to use such a urethane resin for the surface layer 202; however, this urethane resin has a problem that the resistivity is large varied depending on an environment, to thereby make large the dependence of environment on the resistivity of the intermediate transfer member.

An intermediate transfer member has been also proposed in which the entire resistivity thereof is adjusted in a preferable medium resistivity range of $10^3$ to $10^{14}$ Ωcm by a method wherein the rubber-like elastic layer 201 is made from a rubber material whose volume resistivity is set at a relatively controllable value in a range of $10^3$ to $10^9$ Ωcm and the surface layer 202 is made from a resin having a relatively high volume resistivity. However, in the case where the resistivity of the intermediate transfer member is adjusted by controlling the volume resistivity of the surface layer 202, there occurs a problem. That is, since a general resin material has a high volume resistivity, such a high resistivity is required to be lowered typically by addition of a conductive material such as carbon. This requires complicated steps, for example, a step of preparing a paint in which a conductive material is uniformly dispersed, a step of forming a coating film in which the conductive material is uniformly dispersed, and the like, to degrade the production efficiency and increase the production cost.

Accordingly, it is expected to develop a surface layer which is capable of preferably following elastic deformation of an elastic layer, of easily adjusting a resistivity of the member, and of satisfying functions of preventing contamination of a photosensitive body or the like, preventing adhesion of toner, and reducing a friction coefficient.

Further, for an intermediate transfer member for transferring and holding a toner image formed on an image forming body such as a photosensitive drum onto its surface once and transferring the toner image onto a recording medium such a paper sheet, both in a step of holding a toner image transferred from the image forming body onto the surface of the intermediate transfer member and in a step of transferring the toner image from the intermediate transfer member onto the recording medium, a toner retention force for holding toner on the surface of the intermediate transfer member is an important factor exerting a large effect on a transfer performance.

The toner retention force on the surface of an intermediate transfer member, however, has been judged by testing the intermediate transfer member mounted on a copying machine or a printer, although it is an important factor exerting a large effect on the transfer performance, and the intermediate transfer member in terms of the toner retention force has been suitably designed by repeating try-and-error on the basis of the test results. And, at present, it is not apparent what kind of material should be selected and how the material should be used to obtain a desired intermediate transfer member.

Accordingly, it is expected to develop an intermediate transfer member used for an electrophotographic system or an electrostatic recording system such as a copying machine or a printer, which is capable of ensuring a preferable toner retention force by certainly evaluating the toner retention force without the need of carrying out any actual test.

SUMMARY OF THE INVENTION

In view of the foregoing, the present invention has been made, and a first object of the present invention is to provide an intermediate transfer member which is excellent in resistance to ozone and heat resistance, and which is capable of stably exhibiting a preferable performance for a long period, of relatively easily adjusting a resistivity, and of reducing a variation in resistivity.

A second object of the present invention is to provide an intermediate transfer member including a surface layer which is capable of preferably following elastic deformation of an elastic layer, of easily adjusting a resistivity of the member, and of satisfying functions of preventing contamination of a photosensitive body or the like, preventing adhesion of toner, and reducing a friction coefficient.

A third object of the present invention is to provide an intermediate transfer member which is capable of ensuring a preferable toner retention force by certainly evaluating the toner retention force without the need of carrying out any actual test, thereby certainly exhibiting a high intermediate transfer performance.

The present inventors have earnestly studied to achieve the above first object, and found that there can be obtained an intermediate transfer member capable of exhibiting a preferable resistance to ozone thereby keeping a preferable intermediate transfer performance for a long period irrespective of a shape of the member and a service condition by forming the intermediate transfer member using a rubber composition, wherein the state of occurrence of cracks in the rubber composition after the rubber composition imparted with 20% of elongation has been exposed for 120 hours to an environment with an ozone concentration of 10 ppm and with a temperature of 40° C. is specified such that no crack is seen, or the number of cracks is at a rank A or B and the size and depth of cracks are at any one of ranks 1 to 4 under the following evaluation standard in accordance with JIS (Japanese Industrial Standard) K6301:

Evaluation Standard

| Number of Cracks | Size and Depth of Cracks |
|---|---|
| A: a small number of cracks | 1: That which can not be seen with the naked eyes but can be confirmed with 10 times magnifying glass |
| B: a large number of cracks | 2: That which can be confirmed with the naked eyes |
| C: numberless cracks | 3: That which is deep and comparatively large (under 1 mm) |
| | 4: That which is deep and larger (1 mm or over to and excluding 3 mm) |
| | 5: That which is 3 mm or more or about to sever |

The present invention has been accomplished on the basis of the above-described knowledge.

The concentration of ozone produced in an image forming apparatus such as a copying machine or a printer differs largely depending on a configuration of the apparatus, and thereby it cannot be unconditionally determined. Upon this, the present inventors have measured the concentration of ozone at a plurality of points of a plurality of kinds of apparatuses each using a wire type discharge system for an electrifying step and a transfer step of an electrophotographic process regarded as being highest in concentration in ozone, and obtained the result that the concentration of ozone produced in each apparatus is in a range of 2 to 6 ppm. On the basis of the result thus measured, the present inventors have found that if an intermediate transfer member having a durability to ozone at a concentration of 10 ppm is developed, such a member can be sufficiently used for most of image forming apparatuses without deterioration due to ozone.

Further, an intermediate transfer member, which is variously formed into a belt, a roller, a drum shape or the like, is possibly used in a state in which it is imparted with strain (compression, elongation, and/or twisting) depending on the shape and arrangement of the member. In this case, the degree of deterioration of the member due to ozone is largely dependent on a mounting state of the member on an image forming apparatus. For example, there is a possibility that even an intermediate transfer member mainly made from an acrylonitrile-butadiene rubber regarded as being poor in resistance to ozone is not deteriorated by exposure to ozone for a long period if the member is little imparted with strain. Upon this, the present inventors have examined a magnitude of strain imparted to an intermediate transfer member depending on the shape and working condition of the member, and found that the largest strain is imparted to a belt-type intermediate transfer member which is stretchingly provided between drive rollers and is circulatedly driven. In this case, the strain occurs due to elongation of the belt. For example, with respect to an intermediate transfer belt used, typically in color printing by the intermediate transfer apparatus shown in FIG. 2, for transferring and holding a toner image formed on an image forming body such as a photosensitive drum onto its surface once and transferring the tone image onto a recording medium, the strain due to elongation applied to the intermediate transfer belt in service is about 12% at maximum. On the basis of the result thus measured, the present inventors have found that if an intermediate transfer member exhibiting a preferably resistance to ozone in a state in which the member is imparted with 20% of elongation is developed, such a member can be sufficiently used for most of service conditions without deterioration due to ozone.

On the basis of the above-described knowledge, the present inventors have further examined to develop a new intermediate transfer member, and found that as described above, there can be obtained an intermediate transfer member capable of keeping an initial performance for a long period without deterioration due to ozone even when being used for any apparatus in any service condition by forming the intermediate transfer member using a rubber composition, wherein the state of occurrence of cracks in the rubber composition after the rubber composition imparted with 20% of elongation has been exposed for 120 hours to an environment with an ozone concentration of 10 ppm and with a temperature of 40° C. is specified such that no crack is seen, or the number of cracks is at a rank A or B and the size and depth of cracks are at any one of ranks 1 to 4 under the above-described evaluation standard, and have accomplished the present invention.

Accordingly, the present invention provides an intermediate transfer member disposed between an image forming body and a recording medium, for transferring and holding a toner image formed on a surface of the image forming body onto a surface of the intermediate transfer member once and then transferring the toner image onto the recording medium, the intermediate transfer member including: a rubber composition, wherein the state of occurrence of cracks in the rubber composition after the rubber composition imparted with 20% of elongation has been exposed for 120 hours to an environment with an ozone concentration of 10 ppm and with a temperature of 40° C. is specified such that no crack is seen, or the number of cracks is at a rank A or B and the size and depth of cracks are at any one of ranks 1 to 4 under the above-described evaluation standard.

The present inventors also have earnestly studied to achieve the above second object, and found that in an intermediate transfer member including a conductive rubber layer and a surface layer formed on a surface of said conductive rubber layer, by forming the surface layer mainly of a polyester based polyurethane resin having a glass-transition temperature in a range of −20 to 20° C. or a polyolefin based polyurethane resin, there can be obtained an advantage that the surface layer is capable of preferably following elastic deformation of the conductive rubber layer thereby positively preventing occurrence of cracks and peeling; ensuring functions of preventing of contamination of a photosensitive body, preventing adhesion of toner, and reducing a friction coefficient; and relatively easily adjusting a resistivity of the member, and therefore, the present inventors have accomplished the present invention.

Accordingly, there present invention provides an intermediate transfer member disposed between an image forming body and a recording medium, for transferring and holding a toner image formed on a surface of the image forming body onto a surface of the intermediate transfer member once and then transferring the toner image onto the recording medium, the intermediate transfer member including: a conductive rubber layer; and a surface layer formed on a surface of the conductive rubber layer; wherein the surface layer is mainly made from a polyester based polyurethane resin having a glass-transition temperature in a range of −20 to 20° C. or a polyolefin based polyurethane resin.

The present inventors have further studied to achieve the above third object, and found that in an intermediate transfer member using a laminated body including one or two or more of conductive rubber layers and one or two or more of coated surface layers, by suitably adjusting a relationship between a dielectric constant of the conductive rubber layers and a volume resistivity of the surface layer, a toner retention force on the surface of the laminated body can be adjusted, and further found that by specifying the laminated body to satisfy two conditions of (1) $0<\log \epsilon b \leqq 6$, and (2) $-2 \log \rho vs+24 \leqq \log \epsilon b \leqq -3 \log \rho vs+54$ where $\epsilon b$ is a dielectric constant of said conductive rubber layer and $\rho vs$ is a volume resistivity of said surface layer, the laminated body ensures a preferable toner retention force, so that it can be certainly judged that the intermediate transfer member using the laminated body exhibits a preferable toner retention force without the need of carrying out any actual test, and therefore, the present inventors have accomplished the present invention.

Accordingly, the present invention provides an intermediate transfer member including: a laminated body including one or more of conductive rubber layers, and one or more of coated surface layers; wherein the laminated body satisfies the following conditions (1) and (2):

$$(1)\ 0<\log \epsilon b \leqq 6$$

$$(2)\ -2\log \rho vs+24 \leqq \log \epsilon b -3 \log \rho vs+54$$

where $\epsilon b$ is a dielectric constant of the conductive rubber layer and $\rho vs$ is a volume resistivity of the surface layer.

DETAILED DESCRIPTION OF THE PREFERRED EMBODIMENTS

Figure 1:
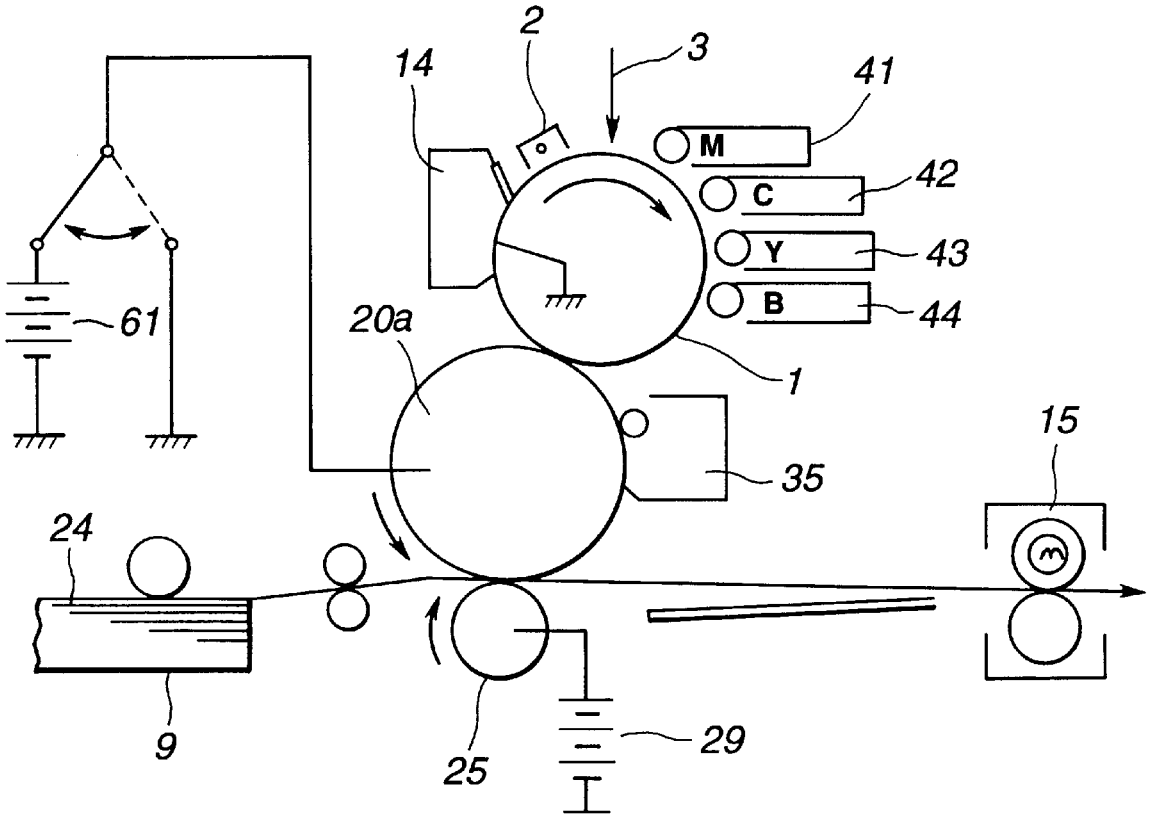
FIG. 1 is a schematic view showing one example of an image forming apparatus in accordance with an intermediate transfer method.

Hereinafter, the present invention will be described in detail with reference to the accompanying drawings.

An intermediate transfer member according the first invention is made from a rubber composition specified such that the state of occurrence of cracks in the above-described resistance to ozone test satisfies the above-described requirement, and therefore, such an intermediate transfer member is capable of certainly, stably exhibiting a preferable resistance to ozone.

A rubber component constituting the above rubber composition can be suitably selected depending on physical properties required for a target intermediate transfer member, insofar as the selected rubber component can constitute the rubber composition satisfying the requirement of the above resistance to ozone test. Here, one kind of rubber or a mixture of two kinds of rubbers may be used as the above rubber component. To be more specific, as the rubber component, there may be used one kind or a mixture of two kinds or more selected from an acrylonitrile-butadiene rubber (NBR), ethylene-propylene rubber (EPM, EPDM), styrene-butadiene rubber (SBR), butadiene rubber (BR), isoprene rubber (IR), natural rubber (NR), silicone rubber, urethane rubber, acrylic rubber (AR), chloroprene rubber (CR), butyl rubber (IIR), and epichlorohydrin rubber (ECO).

In this case, while not exclusively, a mixed rubber containing 30 wt % or more of a rubber not containing a double bond at its main chain is preferably used as the rubber component. Such a rubber component certainly provides a rubber composition capable of satisfying the requirement of the resistance to ozone test. As the rubber not containing a double bond at its main chain, there may be used one kind or two kinds or more selected from an ethylene-propylene rubber (EPM, EPDM), epichlorohydrin rubber (ECO), acrylic rubber (AR), and silicone rubber. In this case, the rubber not containing a double bond at its main chain may have a reactive double bond at its side chain for ensuring reactivity upon vulcanization, for example, ethylidene-norbornane, dicyclopentadiene, or 1,4-hexadiene in an ethylene-propylene rubber (EPM, EPDM), acrylglycidylether in an epichlorohydrin rubber (ECO), or a vinyl group in silicone rubber.

The rubber component may contain a rubber not containing a double bond at its main chain in an amount of 30 wt % or more, preferably, 40 wt % or more, more preferably, 50 wt % or more. When the content of the rubber not containing a double bond at its main chain is less than 30 wt %, the effect of improving the resistance to ozone by addition of such a rubber cannot be sufficiently attained, with a result that the rubber composition containing such a rubber may fail to certainly satisfy the requirement of the resistance to ozone test.

The rubber component may further contain a rubber containing a double chain at its main chain depending on physical properties required for a target intermediate transfer member. As the rubber containing a double bond at its main chain, there may be used one kind or two kinds or more selected from a styrene-butadiene rubber (SBR), butadiene rubber (BR), isoprene rubber (IR), acrylonitrile-butadiene rubber (NBR), chloroprene rubber (CR), butyl rubber (IIR), and natural rubber (NR).

While a mixed rubber containing a rubber not containing a double bond at its main chain in an amount of 30 wt % or more is preferably used as a rubber component constituting the above rubber composition as described, a mixed rubber in which an EPDM and NBR are mixed at a mixing ratio by weight of EPDM/NBR=90/10 to 55/45 is more preferably used as a rubber component constituting the above rubber composition. The use of a mixed rubber of EPDM/NBR is effective to more certainly obtain a rubber elastic body excellent in resistance to ozone and heat resistance, to ensure a preferable conductivity by addition of a conductive agent in a small amount, and to relatively easily adjust a resistivity of the rubber elastic body.

The above EPDM is a ternary polymer of ethylene, propylene, and a slight amount of a third component having a double bond. Examples of the third components may include dicyclopentadiene, ethylidenenorbornane, and 1,4-hexadiene. The mixing ratio of ethylene, propylene, and the third component may be set, while not exclusively, with 50 to 75 wt % of ethylene, 25 to 50 wt % of propylene, and 5 to 30 (iodine number) of the third component. Further, while not exclusively, a Mooney viscosity $ML_{1+4}$ (100° C.) of the above EPDM is preferably in a range of 30 to 110.

Meanwhile, the above NBR is a copolymer of butadiene and acrylonitrile. In this case, while not exclusively, the mixing ratio is preferably set with 20 to 50 wt % of acrylonitrile and the Mooney viscosity $ML_{1+4}$ (100° C.) of the NBR is preferably in a range of 30 to 90.

The mixing ratio by weight of the above EPDM and NBR may be set at EPDM/NBR=90/10 to 55/45, preferably, 85/15 to 61/39, more preferably, 85/15 to 65/35. When the mixing ratio is out of EPDM/NBR=90/10 to 55/45, the resistance to ozone and heat resistance may be lowered, and it may be difficult to adjust the conductivity by addition of carbon or the like.

There are two reasons for improvement in resistance to ozone, heat resistance, and controllability of conductivity by use of a mixed rubber in which the EPDM and NBR are mixed at the above mixing ratio. At first, since the EPDM and NBR are not compatible to each other, a mixture thereof has a sea-island structure with the EPDM side being rich at the above mixing ratio. In this case, the EPDM is taken as the sea and the NBR is taken as islands. As a result, preferable properties, resistance to ozone and heat resistance, of the EPDM exert a desirable effect on the entire mixture, to provide a semi-conductive rubber material excellent in resistance to ozone and heat resistance. In a general application of the intermediate transfer member, such a rubber material exhibits a preferable performance without the need of addition of any ozone-deterioration agent and thermal ageing preventive agent. At second, when the rubber mixture is added with carbon black, carbon black may be distributed at interfaces of the sea-island structure, and consequently, it is possible to obtain a low resistivity only by addition of carbon black in a small amount, and hence to obtain a rubber composition having a low hardness and a low resistivity suitable for an elastic layer of an intermediate transfer member.

In addition, as described above, the rubber component in the rubber composition is preferably composed of a mixed rubber having a rubber not containing a double bond at its main chain, particularly, a mixed rubber of EPDM/NBR; however, 100% of the rubber component may be composed of a rubber not containing a double bond at its main chain, or the rubber component does not contain a rubber not containing a double bond at its main chain at all if the rubber composition including the rubber component satisfies the requirement of the resistance to ozone test.

The rubber composition constituting the intermediate transfer member of the present invention may contain a conductive agent for imparting or adjusting a conductivity as needed, in addition to the above rubber component. Any known conductive agent can be used depending on the application; however, while not exclusively, carbon black is preferably used. It is preferred to adjust a volume resistivity of the rubber composition in a range of $10^3$ to $10^{10}$ Ωcm, preferably, in a range of $10^4$ to $10^9$ Ωcm by addition of carbon black. When the volume resistivity of the rubber composition is less than $10^3$ Ωcm, there may occur leakage of charges when a voltage is applied; while when it is more than $10^{10}$ Ωcm, the conductivity may be insufficient.

The content of the conductive agent may be suitably adjusted depending on the kind thereof for obtaining the above preferable volume resistivity of the rubber composition. In the case of using carbon black as the conductive agent, however, the content of carbon black may be, while not exclusively, in a range of 1 to 100 parts by weight, preferably, in a range of 1 to 70 parts by weight, more preferably, in a range of 5 to 40 parts by weight on the basis of 100 parts by weight of the rubber component. In this case, generally, in the case of using carbon black having small particle sizes (about 10 to 30 nm), the content thereof becomes small, while in the case of using carbon black having large particle sizes (about 30 to 100 nm), the content thereof becomes large. The addition of the conductive agent in an amount of more than 100 parts by weight is undesirable because a hardness of the rubber composition becomes excessively higher.

Here, while not exclusively, the above carbon black is preferably specified to have a nitrogen absorption specific surface area of 20 to 150 $m^2/g$ and a dibutylphthalate (DBP) oil absorption amount of 60 to 180 ml/100 g. In particular, the above mixed rubber of EPDM/NBR added with such specified carbon black is allowed to exhibit a relatively moderate percolation curve and to relatively easily adjust the resistivity. In this case, when the nitrogen absorption specific surface area is less than 20 $m^2/g$, the sizes of particles of carbon black become excessively larger, with a result that carbon black must be added in a large amount to obtain a specific resistivity and the hardness of the rubber composition becomes excessively larger. Such a rubber composition having an excessively large hardness may be undesirable for an elastic layer of an intermediate transfer member. Meanwhile, when the nitrogen absorption specific surface area is more than 150 $m^2/g$, sizes of particles of carbon black become excessively smaller, with a result that it is difficult to uniformly disperse carbon black in the rubber composition. Such a rubber composition in which carbon black is not uniformly dispersed may cause a variation in resistivity of an elastic layer made from the rubber composition. On the other hand, when the DBP oil absorption amount is less than 60 ml/100 g, the development of the structure is excessively lower, with a result that carbon black must be added in a large amount to lower the resistivity in a target resistivity range and thereby the hardness of the rubber composition may become excessively higher. Besides, when the DBP oil absorption amount is more than 180 ml/100 g, the development of the structure becomes excessively larger, with a result that the resistivity significantly varies depending on addition of a small amount of carbon black. This may make it difficult to control the resistivity. The nitrogen absorption specific surface area is preferably in a range of 20 to 120 $m^2/g$, and the DBP oil absorption amount is preferably in a range of 80 to 150 ml/100 g.

The above nitrogen absorption specific area can be measured by a Brunauer Emmett Teller method (BET) absorption specific area measurement method using nitrogen gas, concretely, in accordance with American Standard Material (ASTM) D4820. Meanwhile, the DBP oil absorption amount can be measured by an absorption meter method using DBP, concretely, in accordance with ASTM D 4821.

In addition, as the above-described carbon black, there is preferably used furnace black such as Super Abrasion Surface(SAF), Intermediate Super Abrasion Furnace (ISAF), High Abrasion Furnace (HAF), Fast Extrusion Furnace (FEF), General Purpose Furnace (GPF), Super Processing Furnace (SPF), and Fine Thermal (FT), or channel black.

As described above, carbon black is preferably used as the conductive agent added to the rubber composition; however, a conductive agent other than carbon black can be of course used. Examples of the conductive agents other than carbon black include a cationic surface active agent, for example, a quaternary ammonium salt such as a perchlorate, chlorate, borofluoride, sulfate, ethosulfate, benzyl halide (for example, benzyl bromide or benzyl chloride) of lauryl trimethylammonium, stearyl trimethylammonium, octadecyl trimethylammonium, dodecyl trimethylammonium, hexadecyl trimethylammonium, or modified fatty acid-dimethylethyl ammonium; an anionic surface active agent such as an aliphatic sulfonate, higher alcohol sulfate, higher alcohol sulfate added with ethylene oxide, or higher alcohol phosphate; an amphoteric surface active agent such as betaine; an anti-static agent, for example, a non-ionic anti-static agent such as higher alcohol ethylene oxide, polyethylenegrycol fatty acid ester, or polyhydric alcohol fatty acid ester; a salt of a group I metal such as $LiCF_2SO_2$, $NaClO_4$, $LiBF_4$ or NaCl; a salt of a group II metal such as $Ca(ClO_4)_2$; the above anti-static agent having one or more groups (hydroxy group, carboxyl group, primary or secondary amine group) containing active hydrogen reacting with isocyanate; an ionic conductor agent such as a complex of the above material and a polyhydric alcohol (1,4-butanediol, ethylene glycol, polyethylene glycol, propylene glycol or the like) or its derivative, or a complex of the above material and ethyleneglycol monomethylether, ethyleneglycol monoethylether or the like; color ink carbon subjected to oxidation, pyrolytic carbon, natural graphite, or artificial graphite; metal and metal oxide such as tin oxide, titanium oxide, zinc oxide, nickel or copper; and a conductive polymer such as polyaniline, polypyrrole or polyacetylene.

In this case, to adjust a resistivity of the rubber composition, the rubber composition may contain, in addition to the above carbon black, an ionic conductive material such as sodium perchlorate or tetraethylammonium chloride, or a surface active agent such as dimethylpolysiloxane or polyoxyethylenelaurylether in a small amount. In the case of using the above additive in combination of carbon black, the added amount thereof may be in a range of 0.01 to 10 parts by weight, preferably, in a range of 0.01 to 5 parts by weight, more preferably, in a range of 0.05 to 2 parts by weight on the basis of 100 parts by weight of the rubber component. The addition of such an additive in an amount of 10 parts by weight is undesirable because the resistivity of the rubber composition becomes excessively lower.

A bridging agent and a vulcanizing agent for bridging rubber may be also added. In each of organic peroxide bridging and sulfur bridging, there may be used a bridging assistant, bridging accelerator, and bridging retarding agent. In the case of using the above mixed rubber of EPDM/NBR, organic peroxide is preferably used for effectively performing co-bridging of EPDM and NBR thereby enhancing compression set and creep characteristic. This makes it possible to obtain an elastic body having a compression et of 15% or less. In addition, bridging may be performed at 120 to 180° C. for about 5 to 60 min.

The rubber composition may be further added with compounding agents generally used for rubber, for example, a peptizer, foaming agent, plasticizer, softener, tackifier, anti-tack agent, dispersant, mold lubricant, extender, and coloring agent. Additionally, to prevent the ageing of the rubber composition, an oxidation preventive agent and ageing preventive agent may be added.

The rubber composition constituting the intermediate transfer member of the present invention is, as described above, specified such that the state of occurrence of cracks in the rubber composition after the rubber composition imparted with 20% of elongation has been exposed for 120 hours to an environment with an ozone concentration of 10 ppm and with a temperature of 40° C. is specified such that no crack is seen, or the number of cracks is at a rank A or B and the size and depth of cracks are at any one of ranks 1 to 4 under the following evaluation standard in accordance with JIS (Japanese Industrial Standard) K6301:

Evaluation Standard

| Number of Cracks | Size and Depth of Cracks |
|---|---|
| A: a small number of cracks<br>B: a large number of cracks<br>C: numberless cracks | 1: That which can not be seen with the naked eyes but can be confirmed with 10 times magnifying glass<br>2: That which can be confirmed with the naked eyes<br>3: That which is deep and comparatively large (under 1 mm)<br>4: That which is deep and larger (1 mm or over to and excluding 3 mm)<br>5: That which is 3 mm or more or about to sever |

In this case, means for carrying out the above resistance to ozone test such as preparation of the test piece and the testing apparatus, and the conditions other than the above one are based on the resistance to ozone test in accordance with JIS (Japanese Industrial Standard) K6301. The test piece and testing apparatus will be described below.

Test Piece: Test piece used for the test shall, as a rule, be the rectangular shaped one about 60 mm long, about 10 mm wide and about 2 mm thick with a flat and smooth surface.

Testing Apparatus:

Test Chamber: Test chamber shall have a capacity of 100 l or more. Its inside shall be shielded from light coming from the outside as far as possible and lined with a material which is hardly decomposed by ozone.

Ozone Generator: Ozone generator with quartz mercury arc lamp shall be capable of adjusting the amount of ozone generated by changing its primary load voltage.

Here, while not exclusively, the rubber composition is preferably specified such that a compression set thereof under JIS K6301 is 20% or less, preferably, 10% or less; and a hardness thereof measured by the type A hardness tester under JIS K6301 is in a range of 70 to 25. By forming the conductive rubber member of the intermediate transfer member using the rubber composition having such physical properties, it is possible to effectively prevent occurrence of a defective linear image which is liable to occur when the intermediate transfer member is used after being left in a non-operational state for a long period.

More specifically, when image formation is performed by an image forming apparatus such as a printer after the apparatus is left in a non-operational state for a long period, there often occurs a problem that a defective linear image appears on an image formed by the apparatus. Upon this, the present inventors have analyzed a defective linear image occurring upon image formation performed by an intermediate transfer member after the member is left in a non-operational state for a long period, and found that the defective linear image occurs depending on a compression set of the intermediate transfer member caused by press-contact between the intermediate transfer member and other members such as a photosensitive body, cleaning blade, and secondary transfer roller; and further, the present inventors have examined and found that it is possible to prevent occurrence of the above defective linear image by forming a conductive rubber layer as a base member of an intermediate transfer member using the material having the above compression set and hardness.

In this case, to adjust a compression set and hardness of the above rubber composition as described above, while not exclusively, there may be preferably adopted a method of sufficiently promoting bridging reaction with a solid rubber used in combination of a liquid rubber as a plasticizer. As the liquid rubber as a plasticizer, there may be used a liquid NBR, liquid BR, liquid IR, liquid IIR, liquid CR, or liquid AR. The mixed rubber in combination with the liquid rubber can be formed by injection molding at a high moldability. The bridging agent is selected depending on the kind of rubber from various types such as a sulfur vulcanizing type, non-sulfur vulcanizing type, amine vulcanizing type, metal oxide vulcanizing type, and organic hydrogen peroxide vulcanizing type. In particular, the organic hydrogen peroxide vulcanizing type is preferably used in terms of reduction in compression set.

In addition, the compression set test and the hardness test specified under JIS K6301 are as follows:

Compression Set Test

1. Purpose

This test shall be performed for the measurement of the residual strain due to the compression caused by heating of the vulcanized rubber to be used for a part subjected to the static compression or shearing force.

2. Test Piece

Preparation of the test piece shall be performed by any one of the following three methods. In any case, the test piece shall be a right cylindrical shape 12.70±0.13 mm in thickness and 29.0 mm in diameter.

(1) Cutting out the test piece from the product

When the test piece is cut out from the product, the first step is preparing a rubber sheet of prescribed thickness. In this case, if the grinding is required for the adjustment of the thickness, it shall be performed lightly while avoiding the overheating.

Also, care should be taken so as to make the upper and lower surfaces parallel to each other.

Then, the test piece shall cut out with a circular rotary blade 28.70±0.05 mm in inside diameter. At this time care should be taken to make the upper and lower surfaces vertical to the axis of cylinder.

(2) Cutting out the test piece from the rubber block

When the test piece is cut out from the rubber block, as far as possible, the rubber block should be prepared under the same conditions of vulcanization as the product and the operation should be performed according to that described under (1).

(3) Preparing the test piece using a vulcanizing mold

When preparing the test piece using a vulcanizing mold, where practicable, the test piece should be prepared under the same conditions of vulcanization as the product. However, in anticipation of the shrinkage of the test piece it is to be desired that the vulcanizing mold, where the diameter of the test piece is 29.20±0.05 mm, shall be used.

3. Testing Apparatus

Compression device, theremostant and thickness gauge shall be used for the test.

3.1 Compression Device Compression device consists of 2 or more flat compression plates, bolts and nuts for fixing the compression plates and spacers.

Figure 5:
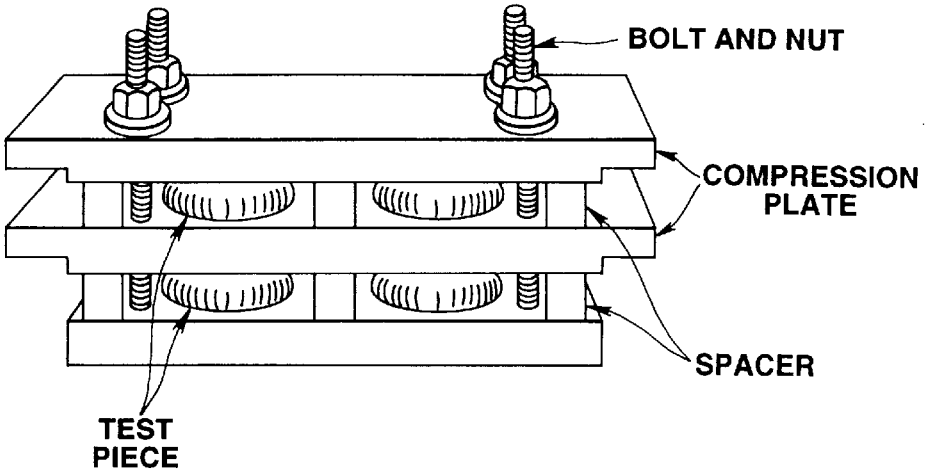
FIG. 5 is a perspective view showing a compression apparatus used for a compression set test under JIS K6301.

Compression plate is made of steel plate and thick enough to withstand the load without bending. Also the compression surface shall be well ground and finished flat and smooth by the chromium plating. An example of the compression device is shown in FIG. 5.

3.2 Thermostat Thermostat shall be well circulated with hot dry air and capable of keeping at the prescribed temperature of ±1° C. for prescribed time.

3.3 Thickness Gage Thickness gage shall have a scale of 0.01 mm and a flat faced loading disc 5 mm in diameter. Its pressure load shall be 0.490N (50 gf) or under and pressurizing surface shall be circular shape 9.50±0.05 mm in diameter. Also it should be able to mount the test piece on its circular stand with the same diameter as the pressuring surface.

4. Testing Method 4.1 Measurement of Thickness For the measurement of thickness, the thickness gage specified under 3.3 shall be used and the measurement shall be performed at one plate of central portion of the test piece.

4.2 Method of Compression As shown in FIG. 5, spacer of 9.52 (−0.02 to +0.01) mm in thickness shall be inserted on both sides of the test piece. At this time care should be taken not to let the side of the test piece touch the spacer. After the test piece and spacers are inserted, upper and lower compression plates are pressed until the plates come into close contact with the spaces and then bolts and nuts are tightened to maintain this state.

4.3 Compression Rate Compression rate of the test piece shall, as a rule, be 25% of the thickness of the test piece.

4.4 Heat Treatment Temperature and time of the heat treatment at the time of compression test shall, as a rule, be 22 hour (h) at 70±1° C. or 70 h at 100±1° C.

Before the insertion of the test pieces the compression device shall be fully preheated to make it the specified temperature.

The insertion and compression of the test pieces should be carried out as quickly as possible. However, in case that 20 min or more are required at this time, the device shall be heated by steeping it in the hot water of the test temperature for 20 min after compression.

After the completion of the insertion and compression of the test pieces, the compression device shall be placed in the thermostat maintained at the specified temperature for the prescribed time.

4.5 Measuring Method When the heat-treatment completes, the test piece shall be taken out as quickly as possible from the compression device and shall be allowed to stand at room temperature for 30 min on the wooden desk to cool until the performance of the last measurement of the thickness according to that described under 4.1.

4.6 Calculation Rate of the compression set shall be calculated by the following formula:

$$CS=(t_0-t_1)/(t_0-t_2)\times 100$$

where,

CS: rate of compression set (%)

$t_0$: original thickness of test piece (mm)

$t_1$: thickness of test piece measured 30 min after it was taken out from the compression device (mm)

$t_2$: thickness of spacer (mm)

5. Arrangement of Test Results

Test results shall, as a rule, be expressed by the average of compression set rates (%) of three test pieces.

6. Record

Following items shall be recorded in the test results.

(1) Compression set rate (%)

(2) Temperature and time of heat-treatment (3) Temperature of test (4) Other necessary matters Hardness Test 1. Purpose This test shall be performed for the measurement of hardness of the vulcanized rubber. Hardness tests shall, as a rule, be performed by one of the following methods.

(1) Spring type hardness test (type A and type C)

(2) Constant load type (Olsen) hardness test (3) Constant load type (Pusey-Johnes) hardness test 2. Spring Type Hardness Test (Type A and Type C)

2.1 Test Piece A test piece shall, as a rule, be not less than 12 mm thick in type A. In case that the thickness is below 12 mm, laminate, if possible, to obtain the thickness of not less than 12 mm. In the case of type C, a test piece not less than 6 mm thick shall be used and in case that the thickness is below 6 mm, laminate, if possible, to obtain the thickness of not less than 6 mm.

When the surface of the test piece to be measured (2) is not flat, grind so as to make it flat.

Note (2) Surface to be measured shall be large enough to let the loading disc of the tester come within the measuring boundary.

Figure 6:
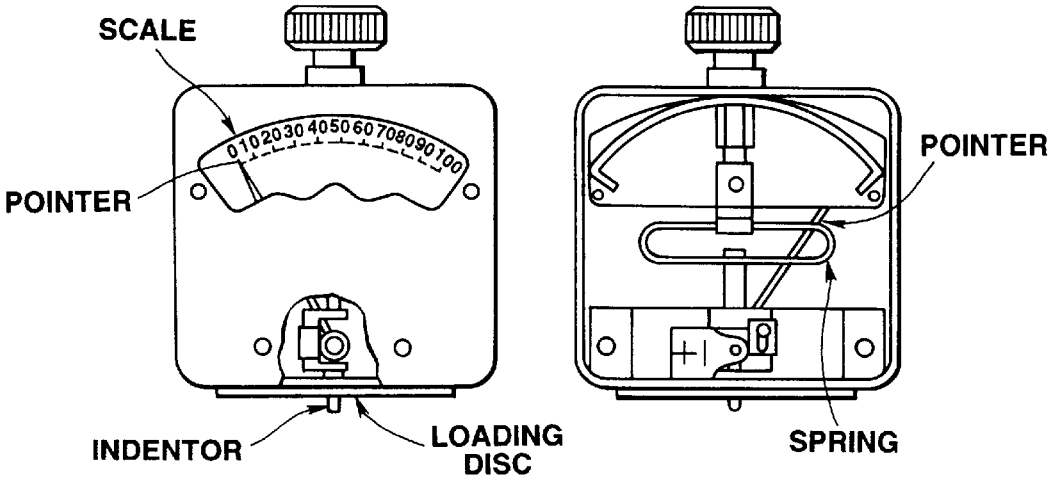
FIG. 6 is a front view showing a hardness tester under JIS K6301, added with an internal configuration illustrative view.

2.2 Tester Type A or type C of the spring type hardness tester shown in FIG. 6 shall be as the tester.

When the loading disc (3) of this test comes into contact with the surface of the test piece indentor (5) projecting from a hole in the center of the loading disc by means of a spring force (4) is pushed back by the surface of the rubber and this distance is indicated by a pointer on the scale (6) as the hardness.

The tester shall be inspected at least every three months.

Figure 7:
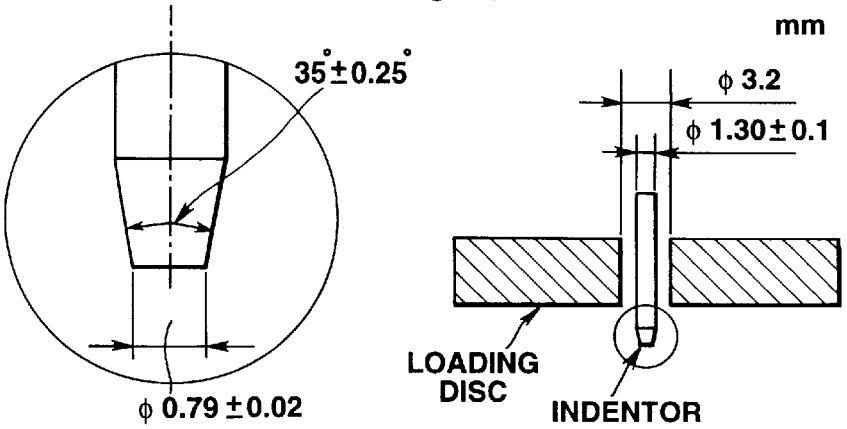
FIG. 7 is an enlarged view showing a leading end portion of a probe of the hardness tester shown in FIG. 6.

Notes:

(3) The loading disc is a plane at right angles to the indentor and has a hole in its center to pass through the indentor as shown in FIG. 7. Diameter of the hole shall be not less than 10 mm.

Figure 8:
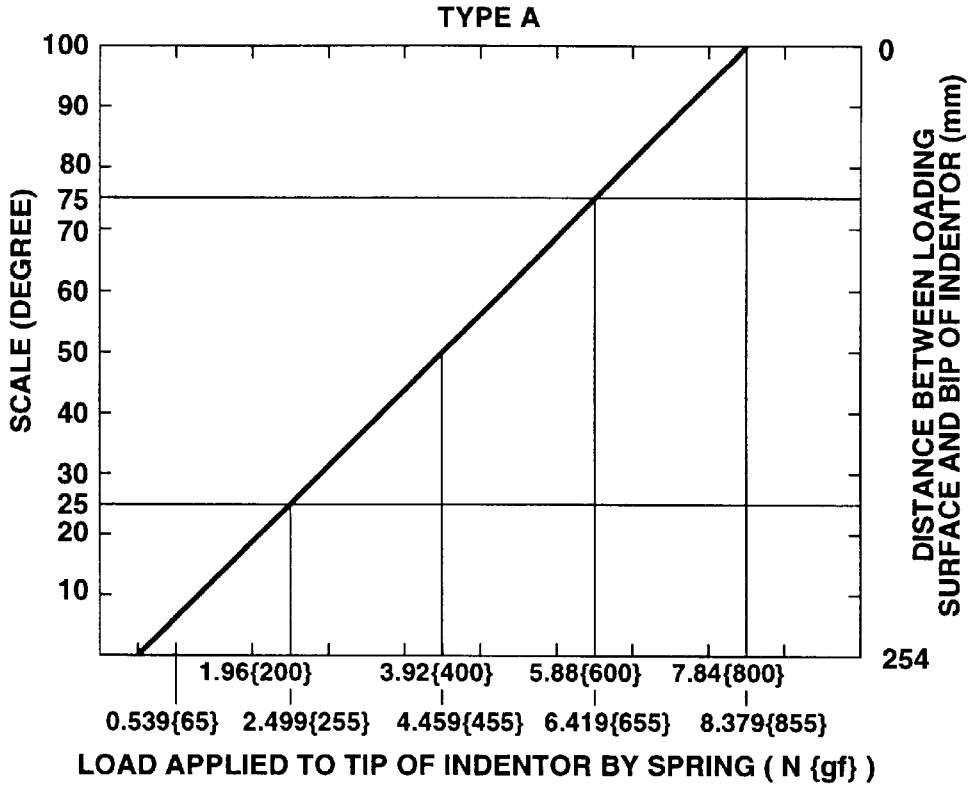
FIG. 8 is graphs each showing a relationship between scales (moved distances of the probe) and spring forces.
Figure 8:
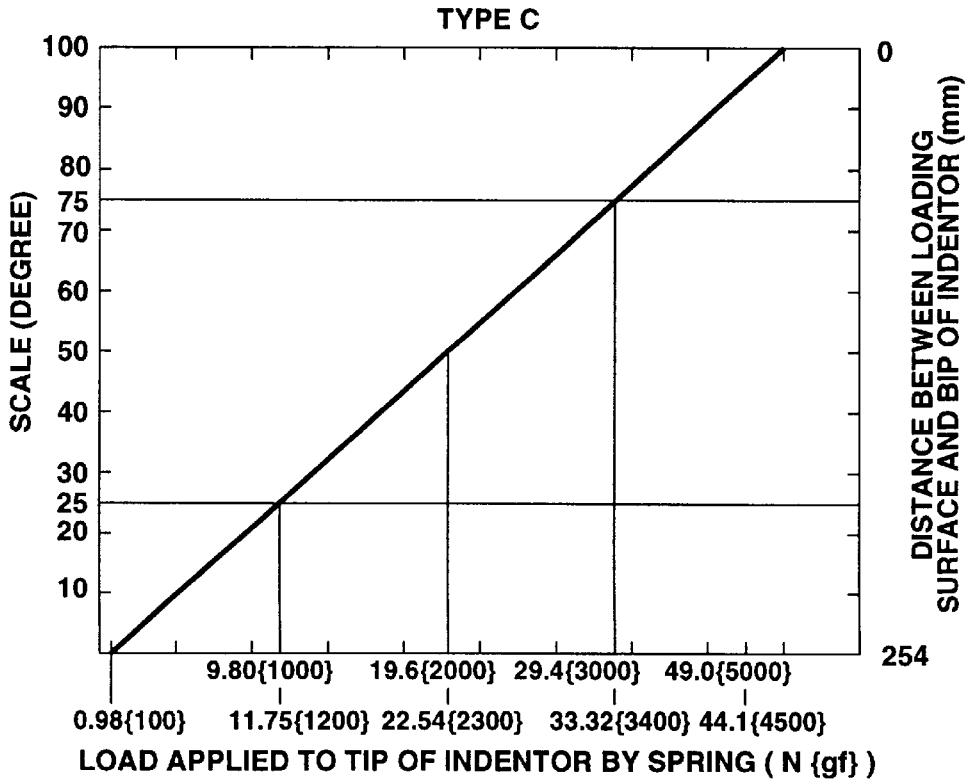

(4) Tolerance ion the reference line (refer to FIG. 8) showing the relation among the scale, movement of the indentor and force of the spring shall be ±0.0785N (±8 gf) in case of type A, and ±0.196N (±20 gf) in case of type C.

Further, there should be no play between the movement of indentor and that of pointer.

(5) Material of indentor shall be highly resistant to wear and also highly resistant to rust and shape and dimensions of indentor shall be as shown in FIG. 7.

The indentor shall be fitted correctly at the center of the hole of the loading surface and when the pointer indicates zero on the scale the tip of the indentor shall be projected from the loading surface by 2.54 (−0.05 to 0) mm and when the pointer indicates 100 on the scale the tip of the indentor shall be on the same level with the loading surface.

(6) The scale shall be divided evenly from 0 to 100.

2.3 Testing Method Keep the tester vertically and let the loading surface contact with the test piece so as to make the indentor vertical to the surface of the test piece to be measured. Then immediately read the scale and obtain the hardness of the test piece. In case that the reading is made after a certain hour elapsed from making contact with the loading surface, the tester shall be kept vertically and it is desirable to use a proper auxiliary apparatus which is constructed so as to make the indentor perpendicular to the surface to be measured before the test.

In this case vertically press type A tester with a load of 9.807N (1000 gf) and type C tester with a load of 49.03N (5000 gf) and read the scale.

Remarks: Type C hardness tester is suitable for the sample which shows the hardness of about not less than 70 by type A.

Moreover, it is desirable to use type C tester for the sample, measured values of which is 30 or more to and excluding 90.

Figure 3:
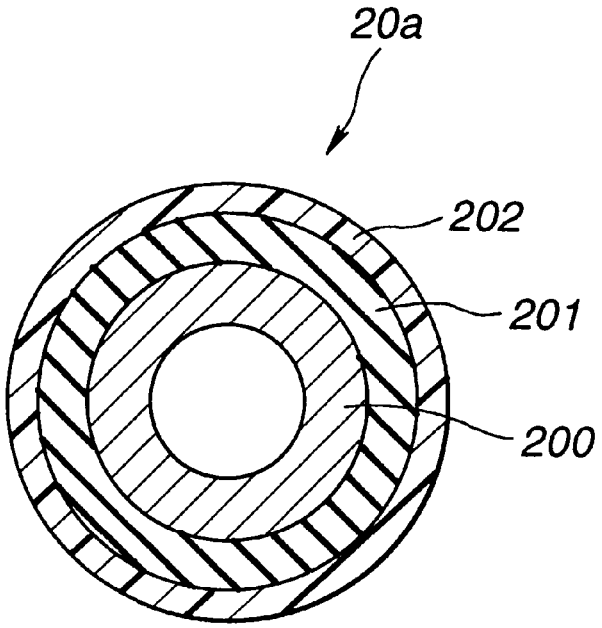
FIG. 3 is a schematic sectional view showing one example of a drum-like intermediate transfer member according to the present invention.
Figure 4:
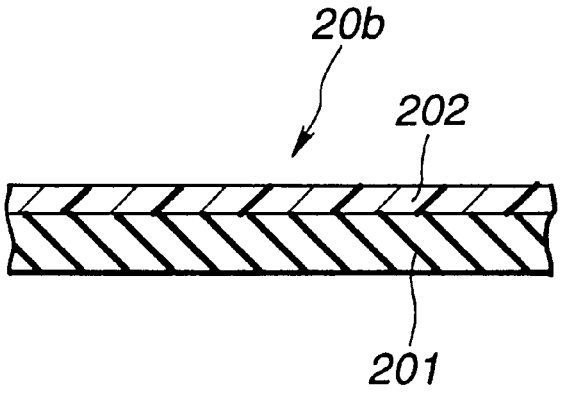
FIG. 4 is a schematic partial sectional view showing one example of a belt-like intermediate transfer member according to the present invention.

The intermediate transfer member is formed of the above rubber composition which is formed into a suitable shape such as a belt or drum-like shape depending on the configuration of an intermediate transfer apparatus. For a drum-like intermediate transfer member as shown in FIG. 3, the conductive rubber layer 201 made from the above rubber composition can be formed on the outer peripheral surface of the drum-like base 200 made from a resin, aluminum alloy, iron alloy or copper alloy. For a belt-like intermediate transfer member as shown in FIG. 4, a belt main body can be formed of the conductive rubber layer 201 made from the above rubber composition. In this case, the conductive rubber layer 201 can be reinforced by providing a reinforcing layer.

The thickness of the conductive rubber layer 201 made from the rubber composition is not particularly limited but may be suitably set depending on the kind of the rubber material and the shape of the intermediate transfer member. However, the thickness of the conductive rubber layer 201 is preferably set in a range of about 2 to 10 mm for a drum-like intermediate transfer member, and is preferably set in a range of about 0.5 to 3 mm for a belt-like intermediate transfer member. In addition, two or more of the conductive rubber layers 201 may be formed, and for example, in the case of a belt-like intermediate transfer member, a belt main body may be formed by laminating the conductive rubber layers on both sides of a reinforcing layer.

As the reinforcing layer, there may be used a resin reinforcing layer and/or a fiber layer. The resin reinforcing layer may be made from a known thermoplastic resin (including an elastomer) or a thermosetting resin, for example, a polycarbonate resin, polyester resin, polyamide resin, polyimide resin, polyurethane resin, polyether resin, polyvinyl resin, polyvinylidene resin, poly(ether-ether-keton) resin, or polysulfone resin. In this case, a plurality of resin reinforcing layers may be used, and further, the resin reinforcing layer may be used in combination with a fiber layer (which will be described later).

The fiber layer may be formed of a known woven fabric or nonwoven fabric of, for example, a natural fiber such as hemp, hair, silk or cotton; a regenerated fiber such as viscose; a synthetic fiber such as a fiber of polyester, nylon (nylon 6, 66 or 46), vinylon, vinylidene chloride, polyolefin (polyethylene or polypropylene), or polychlal; a semi-synthetic fiber such as acetate fiber; a so-called high function fiber such as an aramid fiber, polyvinylalcohol fiber, polyacrylonitrile fiber; or a metal fiber such as a fiber of stainless steel or any other steel else. In this case, the cloth structure of a woven fabric may be suitably selected from a plain weave, twill weave, sateen weave, and a combination thereof. In particular, a plain weave is preferably used in terms of fastness and economical efficiency.

The fiber layer may be of a multi-layered structure of a plurality of laminated layers of the above woven fabric or non-woven fabric. In this case, the thickness of the fiber layer is not particularly limited; however, it may be in a range of 0.01 to 2 mm, preferably, in a range of about 0.05 to 0.5 mm. When the thickness of the fiber layer is less than 0.01 mm, the dimensional stability due to provision of the fiber layer is reduced, tending to cause deformation such as elongation of a belt-like member. Meanwhile, when it is more than 2 mm, the flexibility of the member may be lowered. In addition, while not exclusively, the fiber diameter of a woven fabric or non-woven fabric forming the fiber layer may be in a range of 20 to 420 denier, preferably, in a range of 30 to 210 denier, more preferably, in a range of 30 to 80 denier. The woven fabric or non-woven fabric may be, while not exclusively, relatively thin. Concretely, the thickness of the woven fabric or non-woven fabric may be in a range of 0.01 to 0.2 mm, preferably, in a range of 0.05 to 0.15 mm. When the thickness of the woven fabric or non-woven fabric is less than 0.01 mm, the dimensional stability due to provision of the fiber layer is reduced, tending to cause deformation such as elongation of a belt-like member. Meanwhile, when it is more than 0.2 mm, the flexibility of the member may be lowered.

The entire or the surface portion of the woven fabric or non-woven fabric forming the fiber layer may be impregnated with a rubber or resin as needed. This is effective to improve adhesion between the fiber layer and a conductive rubber layer or a surface layer and also enhance the surface smoothness. In this case, examples of impregnants include a rubber cement containing a rubber of the same kind as that of a rubber forming the above-described conductive rubber layer, epoxy resin, resorcinolformaldehyde (RFL), and a mixture thereof. The above woven fabric or non-woven fabric can be previously impregnated with the impregnant by coating or dipping, to thereby easily obtain a woven fabric or non-woven fabric impregnated with a rubber or resin.

In the intermediate transfer member of the present invention, as shown in FIGS. 3 and 4, a surface layer 202 may be formed, as needed, on the conductive rubber layer 201 made from the above rubber composition for preventing adhesion and fusion of toner. The surface layer 202 may be made from a suitable resin which may be, while not exclusively, selected from a fluorocarbon resin, urethane resin, polycarbonate resin, polyvinylactal resin, acrylic resin, silicon resin, polyester resin, amino resin, epoxy resin, polyamide resin, phenol resin, alkyd resin, melamine resin, keton resin, ionomer resin, polybutadiene resin, chlorinated polyethylene, vinylidene chloride resin, acrylic-urethane resin, acrylic-silicone resin, ethylene-vinyl acetate resin, vinyl chloride-vinyl acetate resin, styrene-butadiene resin, styrene-mallein resin, styrene-acrylic resin, ethylene-acrylic resin, and the like. In particular, a fluorocarbon resin or urethane resin is preferably used in terms of adhesion characteristic with the above conductive rubber layer 201 and followup characteristic to elastic deformation.

In addition, while not exclusively, if the surface layer is made from an urethane resin, it is desired to form the surface layer from a polyester based polyurethane resin having a glass transition temperature of −20° C. to 20° C. or polyolefin based polyurethane resin like a surface layer according to the second invention (which will be described later).

The resistivity of the intermediate transfer member of the present invention is adjusted in a suitable medium resistivity range of $10^8$ to $10^{14}$ Ω cm by adjusting the resistivity of the surface layer 202. In this case, the resistivity of the surface layer 202 may be adjusted by addition of a suitable conductive agent in the surface layer 202 for adjusting the resistivity of the member in the above medium resistivity range; however, it is desirable to adjust the resistivity of the member without addition of a conductive agent in the surface layer 202, by forming the surface layer 202 from a resin having a relatively high resistivity on the conductive rubber layer 201 having a resistivity in a range of $10^3$ to $10^9$ Ω cm. This is effective to easily adjust the resistivity of the member in the above medium resistivity range.

The surface layer 202 may be added with various additives with the above resin taken as a binder. For example, to further reduce a friction resistance and a surface energy and to adjust an electrifying behavior and an electrostatic capacity, the surface layer can be added with various additives such as a fluorocarbon resin, silicone resin, powders thereof, and a lubricant.

In this case, examples of fluorocarbon resins include polytetrafluoroethylene, tetrafluoroethylene-perfluoroalkylvinylether copolymer, tetrafluoroethylene-hexafluoropropylene-perfluoroalkylvinylether copolymer, tetrafluoroethylene-ethylene copolymer, polychlorotrifluoro-ethylene, chlorotrifluoroethylene-ethylene copolymer, polyvinylidenefluoride, and polyvinylfluoride. The addition of the above fluorocarbon resin is effective to prevent adhesion and fusion of toner.

Examples of silicon resins include a methylsilicon, methylphenylsilicon, modified materials thereof, and silicon-epoxy block copolymer. Examples of other additives include barium titanate, potassium titanate, molybdenum sulfide, silica, titanium oxide, zinc oxide, alumina, and graphite. These additives may be added in a suitable amount.

The surface layer 202 can be formed on the above conductive rubber layer 201 by dissolving or dispersing the above resin (binder), hardening agent, and other additives in a solvent to prepare a paint solution, coating the conductive rubber layer 201 with such a paint by a dipping process, roll-coater process, doctor blade process or spraying process, and drying and hardening the paint. As the solvent, there may be used a lower alcohol such as methanol, ethanol, or isopropanol, a keton such as acetone, methyl ethyl keton, or cyclohexanol, toluene, xylene, or a mixed solvent thereof. The thickness of the surface layer 202 is not particularly limited; however, it may be in a range of 1 to 200 μm, preferably, in a range of 3 to 100 μm.

Next, an intermediate transfer member according to the second invention will be described.

The intermediate transfer member according to the second invention is so configured as shown in FIGS. 3 and 4 in which a surface layer 202 is formed on the surface of a conductive rubber layer 201. In the second invention, the surface layer 202 is mainly made from a polyester based polyurethane resin having a glass transition temperature in a range of −20 to 20° C. or polyolefin based polyurethane resin.

The conductive rubber layer 201 may be made from any elastic body, for example, a suitable rubber material added with a conductive material for imparting a conductivity. As the rubber material, like the rubber composition of the intermediate transfer member according to the first invention, there may be one kind or a mixed rubber of two or more kinds selected from a nitrile rubber (NBR), ethylene-propylene rubber (EPDM), styrene-butadiene rubber (SBR), butadiene rubber (BR), isoprene rubber (IR), natural rubber (NR), silicone rubber, urethane rubber, acrylic rubber (ACR), chloroprene rubber (CR), butyl rubber (IIR), and epichlorohydrin rubber (ECO). In particular, according to the second invention, an NBR, urethane rubber, ACR or ECO, or a blended rubber with any rubber else such as an EPDM may be preferably used in terms of adhesion with the above-described polyester based polyurethane resin or polyolefin based polyurethane resin forming the surface layer.

As the conductive agent to be added in the conductive rubber layer 201, like the conductive agent used for the rubber composition of the intermediate transfer member according to the first invention, there may be used a conductive carbon material, metal oxide, conductive polymer, cationic surface active agent, amphoteric surface active agent, antistatic agent, or ionic conductive agent.

The added amount of the conductive agent is not particularly limited. However, to adjust the conductivity of the conductive rubber layer 201 in a range of $10^3$ to $10^9$ Ω cm, preferably, in a range of $10^5$ to $10^8$ Ω cm, in the case of a cationic surface active agent, amphoteric surface active agent, antistatic agent, and ionic conductive agent, the added amount thereof may be in a range of 0.01 to 5 parts by weight, preferably, in a range of 0.05 to 2 parts by weight on the basis of 100 parts by weight of the rubber component; and in the case of a conductive carbon material, metal oxide, conductive polymer or the like, the added amount thereof may be in a range of 1 to 50 parts by weight, preferably, in a range of 5 to 40 parts by weight on the basis of 100 parts by weight of the rubber component. In this case, as described above, the resistivity of the intermediate transfer member is preferably in a medium resistivity range of $10^8$ to $10^{14}$ Ω cm, and it is desirable to adjust the resistivity of the intermediate transfer member in such a medium resistivity range by adjusting the resistivity of the surface layer 202 formed on the conductive rubber layer 201. The conductive rubber layer 201 may be added with an other additive such as a known filler or vulcanizing agent in a suitable amount as needed, in addition to the above-described conductive agent.

Further, like the conductive rubber layer according to the first invention, in the case of using a drum-like intermediate transfer member shown in FIG. 3, the conductive rubber layer 201 may be formed on the outer peripheral surface of the drum-like base 200 made from a resin, aluminum alloy, iron alloy or copper alloy; and in the case of using a belt-like intermediate transfer member shown in FIG. 4, the conductive rubber layer 201 may be provided with a reinforcing layer.

The thickness of the conductive rubber layer 201 is not particularly limited but may be suitably set in accordance with the kind of the rubber material and the shape of the intermediate transfer member. However, the thickness of the conductive rubber layer 201 is preferably set in a range of about 2 to 10 mm in the case of a drum-like intermediate transfer member, and is preferably set in a range of about 0.5 to 3 mm in the case of a belt-like intermediate transfer member.

In addition, while not exclusively, in consideration of the resistance to ozone, the conductive rubber layer 201 is preferably made from the same rubber composition as that used for forming the conductive rubber layer of the intermediate transfer member according to the first invention.

Next, the surface layer 202 formed on the conductive rubber layer 201 is mainly made from a polyester based polyurethane resin or polyolefin based polyurethane resin.

The above polyester based polyurethane resin has a glass transition temperature in a range of −20 to 20° C. as described above. In the case of using the polyester based polyurethane resin having a glass transition temperature out of the above range, it is impossible to achieve the object of the present invention. In an electrophotographic apparatus such as a copying machine, facsimile terminal machine, or printer, an intermediate transfer member is generally used in a temperature environment in a range of about 10 to 30° C. In this case, if the glass transition temperature of a polyester based polyurethane resin forming the surface layer 202 is lower than −20° C., aggregation of molecules of the resin is weak in the service temperature range and thereby the elongation and strength of the surface layer 202 become insufficient, to thereby cause problems that a friction resistance of the surface layer 202 against a photosensitive body becomes excessively larger and the surface layer is worn with toner. On the other hand, if the glass transition temperature of the resin is more than 20° C., the resin is excessively hardened in the above service temperature range, to thereby cause problems that the resin damages a photosensitive body, the surface layer 202 is peeled from the conductive rubber layer 201 because it cannot follow elastic deformation of the conductive rubber layer 201, and the surface layer 202 is cracked. In particular, peeling and cracking of the surface layer 202 become significant in the case of a belt-like intermediate transfer member required to be largely bent upon operation thereof. In addition, the glass transition temperature of the above polyester based polyurethane resin used for the surface layer 202 may be preferably in a range of −10 to 20° C., more preferably, in a range of −10 to 15° C.

The above polyester based polyurethane resin used for the surface layer 202 may be of any type insofar as it has a glass transition temperature in the above range. In particular, a polyester based polyurethane containing phthalic acid and/or isophthalic acid may be preferably used because a glass transition temperature thereof can be easily set in a range of −20 to 20° C. As the above-described polyester polyurethane resin, there may be suitably used a commercial product such as a polyester based polyurethane resin ([TI1500] produced by Sanyo Kasei Co., Ltd.) or a polyester based polyurethane resin ([Nippolan 3124] produced by Nippon Polyurethane Industry Co., Ltd.).

The surface layer 202, which is mainly made from a polyester based polyurethane resin, is obtained by hardening using a hardening agent such as a polyisocyanate hardening agent. The polyisocyanate hardening agent is a polyisocyanate generally used as a row material of a polyurethane such as an aromatic polyisocyanate, aliphatic polyisocyanate, or an alicyclic polyisocyanate. In particular, examples of the aromatic polyisocyanates include a tolylenediisocyanate (TDI), diphenylmethanediisocyanate (MDI), and materials derived and modified therefrom; examples of the aliphatic polyisocyanates include a hexamethylene-diisocyanate, and materials derived and modified therefrom; and examples of the alicyclic polyisocyanates include an isophoronediisocyanate, hydrogenated MDI, and materials derived and modified therefrom.

On the other hand, a polyolefin based polyurethane resin forming the surface layer 202 is obtained by hardening a polyolefinpolyol with a polyisocyanate compound. The polyolefinpolyol is a polymer or copolymer of diene monomers, or a hydrogenated matter thereof, which has a hydroxyl group at a molecular terminal or molecular chain. Examples of the polyolefinpolyols include a polybutadienepolyol, polyisoprerepolyol, poly(butadiene-acrylonitrile)polyol, poly(butadiene-isoprene)polyol, poly(butadiene-styrene)polyol, hydrogenated polybutadienepolyol, hydrogenated polyisoprenepolyol, and hydrogenated poly(butadiene-iroprene)polyol. In particular, a hydrogenated polyol is preferably used in terms of its preferable durability to ozone and/or NOx produced in an electrophotographic apparatus. Meanwhile, in the case of using a polyolefinpolyol not hydrogenated, while not exclusively, it is preferably added with a known ageing preventive agent or an ozone-deterioration preventive agent generally used for rubber. In this case, the added amount of the ageing preventive agent or the ozone-deterioration preventive agent may be in a range of 0.05 to 3 parts by weight on the basis of 100 parts by weight of the polyolefinpolyol.

The polyisocyanate compound has two or more of isocyanate groups in a molecule. Examples of the polyisocyanate compounds include tolylenediisocyanate (TDI), diphenylmethanediisocyanate (MDI), naphthalenediisocyanate (NDI), tolidinediisocyanate (TODI), hexamethylenediisocyanate (HDI), isophoronediisocyanate (IPDI), phenylenediisocyanate, xylylenediisocyanate (XDI), tetramethylxylylenediisocyanate (TMXDI), cyclohexanediisocyanate, lysinesterdiisocyanate, lysinestertriisocyanate, undecanetriisocyanate, hexamethylenetriisocyanate, triphenylmethanetriisocyanate; and polymers, derivatives, modified materials, and hydrogenated materials thereof. In particular, an aliphatic or alicyclic isocyanate such as a hexamethylenediisocyanate or isophronediisocyanate is preferably used in terms of preferable resistance to ozone and heat resistance thereof, and which may be added with an other isocyanate as needed.

The above polyisocyanate compound may be modified with a hydrophilic material having a molecular weight from a low level to a high level for imparting a hydrophilic property. For example, a polyisocyanate compound urethane-modified with a monomer polyol such as ethyleneglycol (EG), 1,4-butaneglycol (1,4-BD), trimethylolpropane (TMP) or a polymer polyol such as a polyetherpolyol or polyesterpolyol; or an adduct polyisocyanate compound is preferably used as a hardening agent for lowering a resistivity of a polyolefin based polyurethane resin.

The resistivity of the intermediate transfer member of the present invention is adjusted in a suitable medium resistivity range of $10^8$ to $10^{14}$ Ω cm by adjusting the resistivity of the surface layer 202. In this case, the resistivity of the surface layer 202 may be adjusted by addition of a suitable conductive agent in the surface layer 202 for adjusting the resistivity of the member in the above medium resistivity range; however, according to the present invention, it is desirable to adjust the resistivity of the member without addition of a conductive agent in the surface layer 202, by forming the surface layer 202 from a polyester based polyurethane resin or polyolefin based polyurethane resin having a volume resistivity in a range of $10^{13}$ to $10^{16}$ Ω cm. This is effective to easily adjust the resistivity of the member in the above medium resistivity range.

To be more specific, the thickness of the surface layer is desired to be generally set at several tens μm in terms of suppression of a hardness of the intermediate transfer member and economical efficiency, and as a result of the experiments performed by the present inventors, in order to adjust the resistivity of the intermediate transfer member in the above medium resistivity range by provision of the surface layer 202 having a thickness of several tens μm, the resistivity of the surface layer 202 is desired to be set in a range of $10^{13}$ to $10^{16}$ Ω cm in consideration of the preferred resistivity of the conductive rubber layer. In this case, to design the surface layer having a resistivity in a range of $10^{13}$ to $10^{16}$ Ω cm using a resin material, there is generally adopted a method of selecting a resin having a high resistivity and lowering the resistivity by addition of a conductive agent such as carbon. However, it is difficult to prepare a paint in which a conductive agent is uniformly dispersed and to form a coating film in which the conductive agent is uniformly dispersed. In other words, according to the above method, it is difficult to obtain a surface layer having a resistivity with no variation. On the contrary, a polyester based polyurethane resin or polyolefin based polyurethane resin used as a main material of the surface layer 202 of the present invention is able to exhibit a volume resistivity in a range of $10^{13}$ to $10^{16}$ Ω cm by itself, and accordingly, by formation of the surface layer 202 using such a resin without addition of any conductive agent, the resistivity of the intermediate transfer member can be easily adjusted in the above medium resistivity range without the need of provision of the complicated operations of preparing a paint in which a conductive agent is uniformly dispersed and forming a coating film in which the conductive agent is uniformly dispersed.

The resistivity of the polyester based polyurethane resin is dependent on the kind thereof, and the above type containing phthalic acid and/or isophthalic acid exhibits a resistivity in a range of $10^{13}$ to $10^{16}$ Ω cm, and therefore, it is preferably used for adjusting the resistivity of the intermediate transfer member.

Meanwhile, a volume resistivity of a polyolefin based polyurethane resin is adjusted in a range of $10^{13}$ to $10^{16}$ Ω cm by use of two kinds or more of polyisocyanate compounds as a hardening agent to a polyolefin based polyol, to thereby suitably adjust the resistivity of the intermediate transfer member.

To be more specific, a polyolefin based polyurethane resin is higher in resistivity than a general urethane resin, and accordingly, in the case where the resistivity of the intermediate transfer member is adjusted by forming a surface layer made from a polyolefin based polyurethane resin on the surface of the member, the resistivity of the member is largely varied depending on a variation in thin thickness of the surface layer, with a result that it is difficult to stably produce the member having a constant resistivity. However, by combination of two kinds or more of polyisocyanate compounds as a hardening agent to a polyolefin based polyol, the volume resistivity of the polyolefin based polyurethane resin can be certainly adjusted in a range of $10^{13}$ to $10^{16}$ Ω cm depending on the kinds of the polyisocyanate compounds and the mixing ratio thereof. As a result, by forming the surface layer made from such an urethane resin on the surface of the member, the resistivity of the member can be easily controlled upon production, and thereby the member having a stable performance can be certainly, stably obtained.

Here, in the case where the volume resistivity of a polyolefin based polyurethane resin is adjusted in a range of $10^{13}$ to $10^{16}$ Ω cm by combination of two kinds of the above polyisocyanate compounds with the kinds and the mixing ratio thereof suitably selected, the mixing ratio may be suitably selected depending on the kinds and the number of the combined polyisocyanate compounds and thereby it is not particularly limited. However, in the case of combination of two kinds of the polyisocyanate compounds, the mixing ratio may be in a range of 1/9 to 9/1, preferably, in a range of 2/8 to 8/2, more preferably, in a range of 3/7 to 7/3 for certainly ensuring the combination effect.

The surface layer 202 is mainly made from the above-described polyester based polyurethane resin or polyolefin based polyurethane resin, and it may be further added with various additives with the polyester based polyurethane resin or polyolefin based polyurethane resin taken as a binder. For example, to further reduce a friction resistance and a surface energy and to adjust an electrifying behavior and an electrostatic capacity, the surface layer can be added with various additives such as a fluorocarbon resin, silicone resin, powders thereof, and a lubricant.

In this case, examples of fluorocarbon resins include polytetrafluoroethylene, tetrafluoroethylene-perfluoroalkylvinylether copolymer, tetrafluoroethylene-hexafluoropropylene-perfluoroalkylvinylether copolymer, tetrafluoroethylene-ethylene copolymer, polychlorotrifluoro-ethylene, chlorotrifluoroethylene-ethylene copolymer, polyvinylidenefluoride, and polyvinylfluoride. The addition of the above fluorocarbon resin is effective to prevent adhesion and fusion of toner.

Examples of silicon resins include a methylsilicon, methylphenylsilicon, modified materials thereof, and silicon-epoxy block copolymer. Examples of other additives include barium titanate, potassium titanate, molybdenum sulfide, silica, titanium oxide, zinc oxide, alumina, and graphite. These additives may be added in a suitable amount.

The surface layer 202 can be formed on the above conductive rubber layer 201 by dissolving or dispersing the above polyester or polyolefin based polyurethane resin, hardening agent, and other additives in a solvent to prepare a paint solution, coating the conductive rubber layer 201 with such a paint by a dipping process, roll-coater process, doctor blade process or spraying process, and drying and hardening the paint. As the solvent, there may be used a lower alcohol such as methanol, ethanol, or isopropanol, a keton such as acetone, methyl ethyl keton, or cyclohexanol, toluene, xylene, or a mixed solvent thereof.

The thickness of the surface layer 202 is not particularly limited; however, it may be in a range of 1 to 80 μm, preferably, in a range of 3 to 50 μm. According to the present invention, since the surface layer 202 is thus thin, it does not cause an inconvenience of hardening the member, and is also prevented from being cracked or peeled because it can follow elastic deformation of the conductive rubber layer 201. Such a surface layer 202 is effective to prevent contamination of a photosensitive body and adhesion of toner and also reduce a friction coefficient, and to easily, preferably adjust the resistivity of the member.

Here, while not exclusively, when the surface layer 202 is exposed for 120 hrs to an environment with an ozone concentration of 10 ppm and with a temperature of 35° C., a variation in electric resistance is preferably in a range of a number of 0.5 figure or less, preferably, in a range of a number of 0.3 figure or less.

More specifically, a resin forming the surface layer of the intermediate transfer member is deteriorated due to ozone generated during operation of an image forming apparatus in which the member is mounted, and thereby the resistivity of the member, with a result that after operation for a long period, the performance of the member may be degraded. In this case, by forming the surface layer 202 of a resin layer specified such that a variation in electric resistance upon exposure for 120 hrs to an environment with an ozone concentration of 10 ppm and with a temperature of 35° C. is in a range of a number of 0.5 figure or less, it is possible to stably keep a preferable resistivity of the member even when the member is mounted in an image forming apparatus and is used for a long period, and hence to stably obtain a preferable image for a long period.

In addition, a variation in electric resistance is determined as follows: namely, the surface layer 202 is subjected to an ozone exposure test under conditions with an ozone concentration of 10 ppm, a temperature of 35° C. and an exposure time of 120 hrs, and a variation in volume resistivity before and after the test is expressed in number of figure. The number of figure is given by the following equation:

number of figure=log {(volume resistivity after test) /(volume resistivity before test)}

In this case, while not exclusively, in order to obtain the surface layer 202 having a preferable resistance to ozone, there may be used, as the hardening agent for the above urethane resin, one kind or a mixture of two or more kinds selected from an aliphatic polyisocyanate compound, alicyclic polyisocyanate compound, and hydrogenated aromatic polyisocyanate compound. In particular, a modified hexamethylenediisocyanate or modified isophoronediisocyanate is preferably used. In terms of heat resistance, an isocyanurate-modified material, biuret-modified material or adduct-modified material of hexamethylenediisocyanate or isophoronediisocyanate is more preferably used.

In addition, the shape of the intermediate transfer member is not limited to a drum-like or belt-like shape as shown in FIGS. 3 and 4, but may be any shape insofar as the member can be stably brought in contact with or in proximity to an image forming body such as a photosensitive body. However, the effect of the present invention can be significantly exhibited in the case of the belt-like shape required to be largely bent upon operation and used while repeating large elastic-deformation.

Next, an intermediate transfer member according to the third invention will be described.

The intermediate transfer member according to the third invention has a basic configuration shown in FIGS. 3 and 4 in which the surface layer 202 is laminated on the conductive rubber layer 201, and is characterized in that a relationship between a dielectric constant of the conductive rubber layer 201 and a volume resistivity of the surface layer 202 is suitably selected to obtain an excellent toner retention.

The conductive rubber layer 201 may be made from an any rubber material generally used for forming a conductive rubber layer of an intermediate transfer member insofar as it satisfies the relationship between a dielectric constant and a volume resistivity (which will be described). For example, there may be used one kind or a mixture of two or more kinds selected from a styrene-butadiene rubber, butadiene rubber, isoprene rubber, acrylonitrile-butadiene rubber, chloroprene rubber, ethylene-propylene rubber, butyl rubber, acrylic rubber, silicon rubber, fluoro rubber, epichlorohidrin rubber, polysulfide rubber, urethane rubber, and natural rubber. In addition, a foam of the above rubber may be also used.

The conductive rubber layer 201 can be formed by addition of a conductive agent to the above rubber material for imparting or adjusting a conductivity of the conductive rubber layer 201. While any known conductive agent may be used in accordance with the application, carbon black is preferably used. It is desirable to adjust a volume resistivity of the conductive rubber layer in a range of $10^3$ to $10^{10}$ Ω cm, preferably, in a range of $10^4$ to $10^9$ Ω cm by addition of carbon black.

The added amount of the conductive agent is suitably adjusted depending on the kind thereof to obtain the above-described preferable volume resistivity, and is not particularly limited. However, in the case of using carbon black as the conductive agent, the added amount thereof may be in a range of 1 to 100 parts by weight, preferably, in a range of 1 to 70 parts by weight, more preferably, in a range. of 5 to 40 parts by weight on the basis of 100 parts by weight of the rubber material. In this case, generally, in the case of using carbon black having small particle sizes (about 10 to 30 nm), the added amount thereof becomes small, while in the case of using carbon black having large particle sizes (about 30 to 100 nm), the added amount thereof becomes large. The addition of the conductive agent in an amount of more than 100 parts by weight is undesirable because a hardness of the conductive rubber layer becomes excessively higher.

To adjust a resistivity of the conductive rubber layer 201, the conductive rubber layer 201 may contain, in addition to the above-described carbon black, an ionic conductive material such as sodium perchlorate or tetraethylammonium chloride, or a surface active agent such as dimethylpolysiloxane or polyoxyethylenelaurylether in a small amount. The added amount thereof may be in a range of 0.1 to 10 parts by weight, preferably, in a range of 0.01 to 5 parts by weight, more preferably, in a range of 0.05 to 2 parts by weight on the basis of 100 parts by weight of the rubber material. The addition of such an additive in an amount of 10 parts by weight is undesirable because the resistivity of the conductive rubber material 201 becomes excessively lower.

A bridging agent and a vulcanizing agent for bridging rubber may be also added. In each of organic peroxide bridging and sulfur bridging, there may be used a bridging assistant, bridging accelerator, and bridging retarding agent. Further, there may be added with compounding agents generally used for rubber, for example, a peptizer, foaming agent, plasticizer, softener, tackifier, antitack agent, dispersant, mold lubricant, extender, and coloring agent. Additionally, to prevent the deterioration of the rubber composition forming the conductive rubber layer 201, an oxidation preventive agent and ageing preventive agent may be added.

Like the intermediate transfer member in each of the first and second inventions, for a drum-like intermediate transfer member as shown in FIG. 3, the conductive rubber layer 201 is formed on the outer peripheral surface of the drum-like base 200 made from a resin, aluminum alloy, iron alloy, or copper alloy; and for a belt-like intermediate transfer member as shown in FIG. 4, the conductive rubber layer 201 may be provided with a reinforcing layer.

The thickness of the conductive rubber layer 201 is not particularly limited and is suitably set in accordance with the kind of a rubber material used therefor and the shape of an intermediate transfer member in which the layer 201 is provided; however, in the case of the drum-like member, the thickness is preferably in a range of about 2 to 10 mm, and in the case of the belt-like member, the thickness is preferably in a range of 0.5 to 3 mm.

In addition, while not exclusively, in consideration of a resistance to ozone, the conductive rubber layer 201 is preferably made from the same rubber composition as that used for forming the conductive rubber layer of the intermediate transfer member according to the first invention.

The surface layer 202 to be laminated on the conductive rubber layer 201 may be made from a suitably selected known material insofar as such a material satisfies the relationship between a dielectric constant and a volume resistivity (described later). Examples of the materials include a fluorocarbon resin, polyurethane, fluoro rubber, polyamide, polyester, alkyd resin, melamine resin, phenol resin, epoxy resin, acrylic resin, acryl-silicone resin, acryl-urethane resin, silicone resin, amino resin, urea resin, chlorinated polyethylene, ethylene-vinyl acetate copolymer, ethylene-ethylacrylate resin, and polyvinyl-acrylate. These resins may be used singly or in combination. In particular, from such a viewpoint that a toner releasing characteristic upon transfer of a toner image held on the surface is an important factor for an intermediate transfer member, a resin containing a fluorocarbon resin or a powder thereof (described later), which is excellent in toner releasing characteristic, is preferably used.

The surface layer 202 may be further added with a powder of a conductive agent such as carbon, metal, metal oxide, or ionic material; fine particles of polytetrafluoro-ethylene, or polyvinylidene fluoride; and fine particles of an inorganic material such as molybdenum sulfide or graphite. Additionally, other additives may be added insofar as they do not reduce the effect of the present invention.

The thickness of the surface layer 202 may be, while not exclusively, in a range of 0.1 to 500 $\mu$m, preferably, in a range of 1 to 100 $\mu$m. When the thickness is less than 0.1 $\mu$m, the surface layer is sometimes not formed at a preferable accuracy. Meanwhile, when the thickness is more than 500 $\mu$m, the flexibility of the surface layer is made poor, and consequently the surface layer sometimes cannot sufficiently follow elastic deformation of the conductive rubber layer and there occurs an inconvenience in terms of economical efficiency. In addition, the surface layer 202 can be formed by preparing a paint containing the above resin incorporated with additives as needed, and coating the conductive rubber layer 201 with the paint by dipping or spraying.

In addition, while not exclusively, in consideration of the durability and adjustment of the resistivity of the intermediate transfer member, the surface layer 202 is preferably made from the same material as that used for the surface layer of the intermediate transfer member according to the second invention.

Each of the conductive rubber layer 201 and the surface layer 202 constituting the intermediate transfer member of the present invention may be of a single layer structure shown in FIGS. 3 and 4; however, with respect to the conductive rubber layer 201 and the surface layer 202, there may be adopted laminated bodies having various structures. For example, two or more of the conductive rubber layers 201 may be coated with two or more of the surface layers 202, and further, one or more of coating layers other than the surface layers 202 may be further provided. Specifically, for the belt-like intermediate transfer member, there may be adopted a three-layered structure of [coating layer (surface layer) A/conductive rubber layer/coating layer (surface layer) B]; or a five-layered structure of [surface layer (coating layer A/coating layer B)/conductive rubber layer A/coating layer C/conductive rubber layer B].

Figure 9:
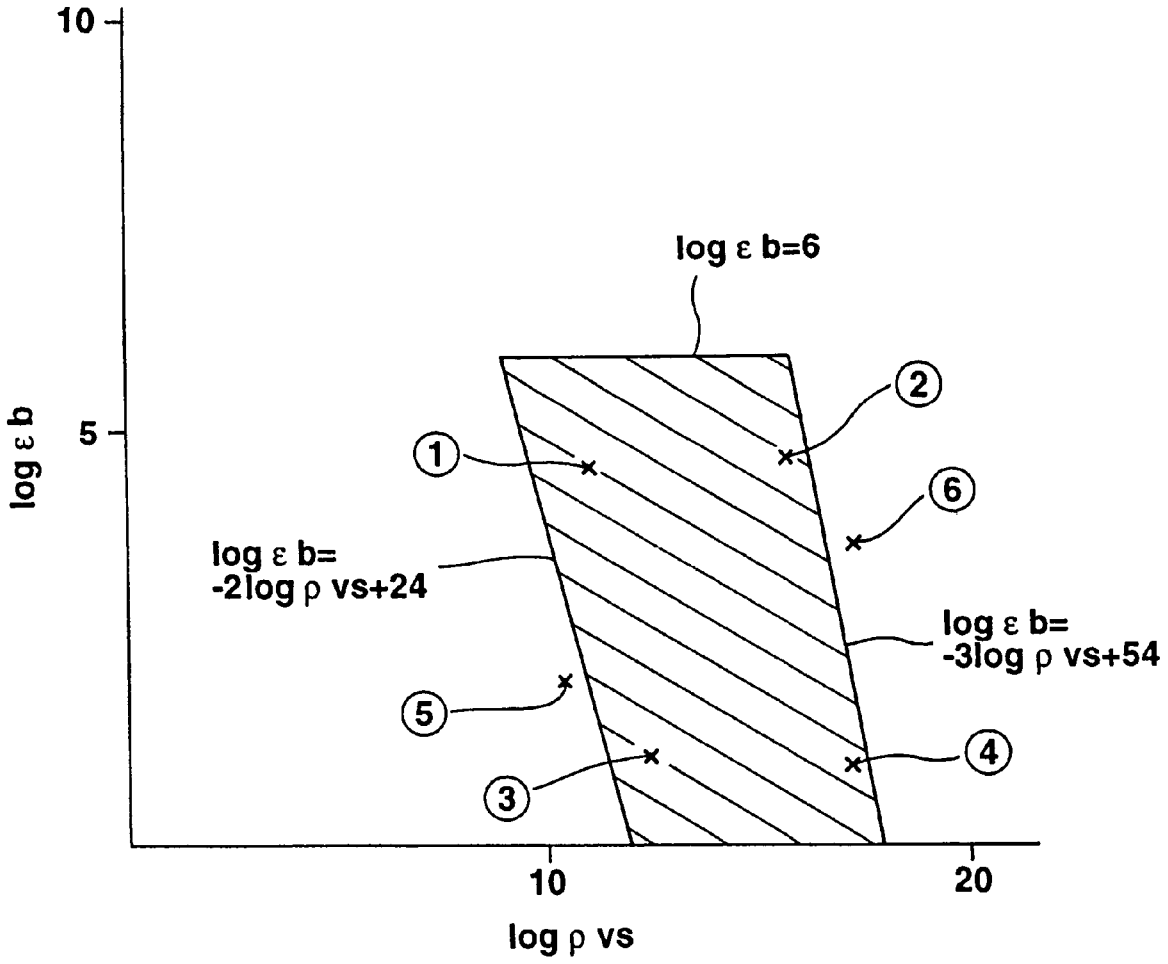
FIG. 9 is a graph showing a relationship between dielectric constants of conductive rubber layers and volume resistivities of surface layers.

The above laminated body constituting the intermediate transfer member of the present invention, which includes the conductive rubber layer 201 and the surface layer 202, is specified such that the relationship between a dielectric constant of the conductive rubber layer 201 and a volume resistivity of the surface layer 202 satisfies the following conditions (1) and (2):

$$(1)\ 0<\log \epsilon b \leqq 6$$

$$(2)\ -2 \log \rho vs+24 \leqq \log \epsilon b \leqq -3 \log \rho vs+54$$

where $\epsilon$ b is the dielectric constant of the conductive rubber layer 201 and $\rho$ vs is the volume resistivity of the surface layer 202. To be more specific, the intermediate transfer member of the present invention is formed of the laminated body including the conductive rubber member 201 and the surface layer 202 which are specified such that the dielectric constant $\epsilon$ b of the conductive rubber layer 201 and the volume resistivity $\rho$ vs of the surface layer 202 are contained in a crosshatching region in FIG. 9. Such a laminated body exhibits a preferable toner retention force, and therefore, it can certainly provide the intermediate transfer member exhibiting a preferable toner retention force without the need of any actual test.

The dielectric constant $\epsilon$ b of the conductive rubber layer 201 can be measured using a commercial measuring device (Impedance Analyzer A4194A produced by HEWLETT-PACKARD COMPANY). Using this measuring device, the dielectric constant $\epsilon$ b can be easily measured by selecting a Cp-Rp circuit and calculating the dielectric constant on the basis of an electrostatic capacity at a frequency of 100 Hz with respect to the thickness and area. The volume resistivity $\rho$ vs of the surface layer 202 can be measured using a commercial measuring device (Resistance Meter R8340A connected to Sample Chamber TR42 both produced by ADVANTEST CORP.). Using this measuring device, the volume resistivity pvs can be easily measured by selecting a measurement voltage in a range of 1 to 1,000 V in accordance with the volume resistivity of the surface layer. For the laminated body including a plurality of the conductive rubber layers 201 and a plurality of the surface layers 202, the total of dielectric constants of the plurality of the conductive rubber layers 201 is taken as the composite dielectric constant $\epsilon$ b used for the above relationship, and the total of volume resistivities of the plurality of the surface layers 202 is taken as the composite volume resistivity pvs used for the above relationship.

Each of the intermediate transfer members according to the first, second and third inventions is formed into a drum-like, a belt-like shown in FIGS. 3 and 4 or the like, and is disposed between an image forming body such as a photosensitive drum and a recording medium such as a paper sheet. More specifically, such an intermediate transfer member is used for the intermediate transfer section (intermediate transfer device) of the image forming apparatus shown in FIG. 1 or 2, in which a toner image formed on the surface of the image forming body is transferred and held on the surface of the intermediate transfer member once and is then transferred on the recording medium. In this case, the intermediate transfer device in which each intermediate transfer member of the present invention is provided is not limited to that shown in FIG. 1 or 2, but may be any device suitably changed within the scope of the present invention insofar as the device allows the intermediate transfer member of the present invention to be disposed between an image forming body and a recording medium and to transfer and hold a toner image formed on the surface of the image forming body on the surface of the member once and then transfer the toner image on the recording medium.

EXAMPLE

The present invention will be more clearly understood with reference to, not exclusively, the following inventive examples and comparative examples.

First, there will be described Inventive Examples 1 to 8 and Comparative Examples 1 to 6 according to the first invention.

[Inventive Examples 1 and 2 and Comparative Example 1]

A woven fabric of polyester fibers was wound around a mandrel and a rubber composition shown in each example of Table 1 was laminated thereon, followed by vulcanization-molding, to prepare a rubber belt. The rubber belt thus prepared was then coated with a paint made from a fluorocarbon resin, to form a surface layer, thus obtaining an intermediate transfer belt. In addition, each content in Table 1 is expressed in parts by weight.

Meanwhile, each rubber composition before used for forming the rubber belt was vulcanization-molded, to prepare a test piece (length: 60 mm, width: 10 mm, thickness: 2 mm). The test piece was exposed for 120 hrs to an environment with an ozone concentration of 10 ppm and with a temperature of 40° C. in a state being imparted with an elongation of 20%, to thereby evaluate the state of occurrence of cracks under the following evaluation standard. The results are shown in Table 1. The resistance to ozone test was performed using a tester (OMS-HVCR type, produced by SUGA TEST INSTRUMENTS CO., LTD.).

| Evaluation Standard | |
|---|---|
| Number of Cracks | Size and Depth of Cracks |
| A: a small number of cracks<br>B: a large number of cracks<br>C: numberless cracks | 1: That which can not be seen with the naked eyes but can be confirmed with 10 times magnifying glass<br>2: That which can be confirmed with the naked eyes<br>3: That which is deep and comparatively large (under 1 mm)<br>4: That which is deep and larger (1 mm or over to and excluding 3 mm)<br>5: That which is 3 mm or more or about to sever |

Figure 2:
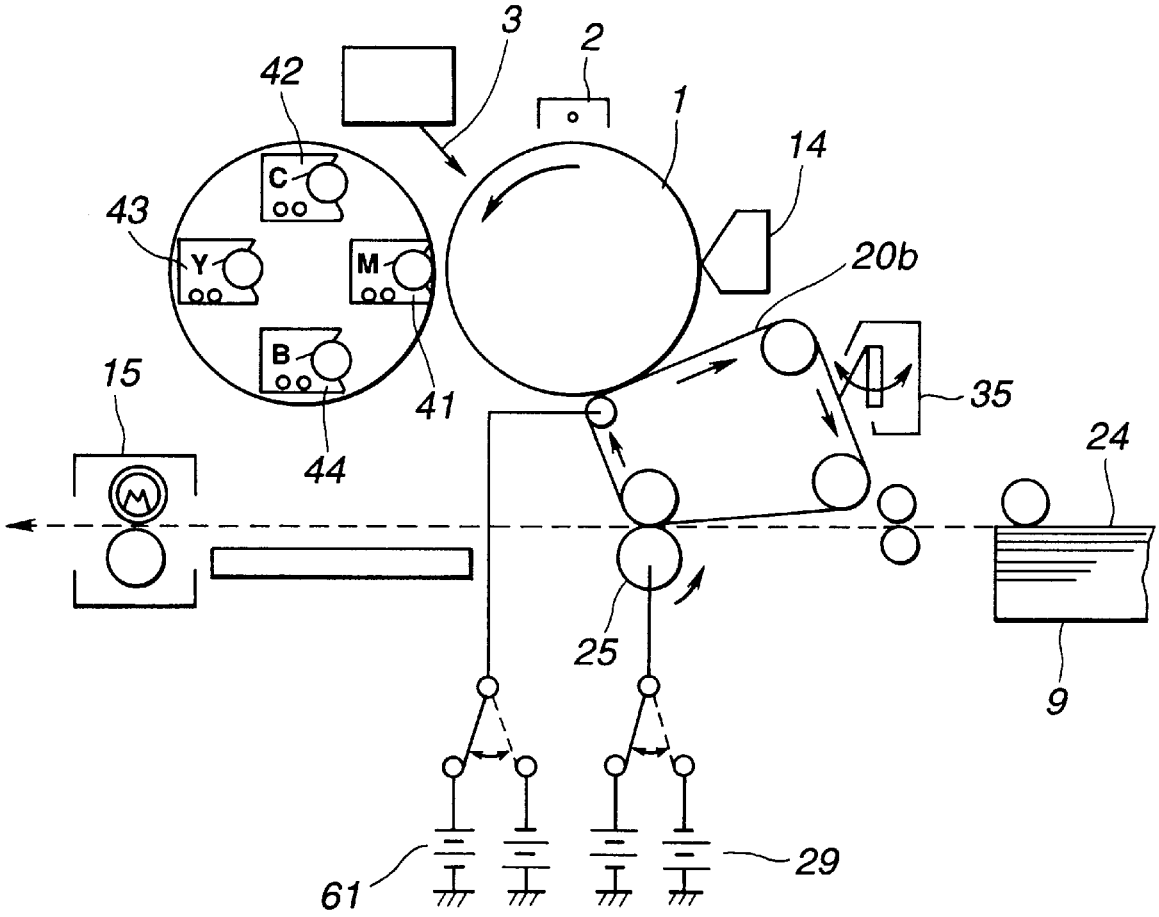
FIG. 2 is a schematic view showing another example of the image forming apparatus in accordance with an intermediate transfer method.

Each intermediate transfer belt was mounted as the intermediate transfer belt 20*b* on the intermediate transfer section of the image forming apparatus shown in FIG. 2, and was subjected to an endurance test by repeating a transfer operation for 100,000 pieces of A4 paper sheets. During this endurance test, the surface of the intermediate transfer belt was randomly observed to confirm the presence or absence of cracks. The results are shown in Table 1.

As shown in Table 1, it is confirmed that the intermediate transfer belt of the present invention is excellent in resistance to ozone and certainly exhibits a preferable performance for a long period.

TABLE 1

| | Inventive Example | | Comparative Example |
|---|---|---|---|
| | 1 | 2 | 1 |
| Rubber Composition | | | |
| acrylonitrile-butadiene rubber (*1) | 60 | 40 | 80 |

TABLE 1-continued

| | Inventive Example | | Comparative Example |
|---|---|---|---|
| | 1 | 2 | 1 |
| ethylene-propylene rubber (*2) | — | 60 | — |
| epichlorohidrin rubber (*3) | 40 | — | 20 |
| carbon black (*4) | 30 | 30 | 30 |
| calcium carbonate | 10 | 10 | 10 |
| magnesium oxide | 3 | — | 2 |
| stearic acid | 2 | 1 | 2 |
| peroxide (*5) | 5 | 5 | 5 |
| Result of Resistance to Ozone Test | | | |
| concentration of 10 ppm, 40° C., elongation of 20% | no change after 120 hrs | no change after 120 hrs | breakage after 48 hrs |
| evaluation | no crack | no crack | C-2 |
| Result of Actual Test | no crack after transfer for 100,000 sheets | no crack after transfer for 100,000 sheets | cracks in rubber surface after 30,000 sheets |

*1) [N-230SV] produced by Japanese Synthetic Rubber Co., LTD.
*2) [EP-33] produced by Japanese Synthetic Rubber Co., LTD.
*3) [Epichloma-CG-102] produced by DAISO CO., LTD.
*4) [Sheast G-SVH] produced by Tokai Carbon Co. Ltd.
*5) [Partible P-40] produced by NOF CORPORATION

[Inventive Examples 3 to 5 and Comparative Examples 2 to 4 ]

Components shown in each example of Table 2 were mixed at a mixing ratio shown in Table 2, being kneaded by a kneader, and subjected to press-bridging at 160° C. for 10 min, to obtain a rubber composition. Each rubber composition was measured in terms of volume resistivity, and also subjected to the following resistance to ozone test and heat test. The results are shown in Table 2. In addition, each content in Table 2 is expressed in parts by weight. Further, reference numerals (*1) to (*4) added to the components in Table 2 are as follows:

(*1): [EP 33 ] produced by Japanese Synthetic Rubber Co., Ltd.

(*2): [N 230 SV] produced by Japanese Synthetic Rubber Co., Ltd.

(*3): [Sheast G-SVH] produced by Tokai Carbon Co., Ltd. (nitrogen absorption specific surface area: 32 $m^2/g$, DBP oil absorption: 140 ml/100 g)

(*4): [Partible P- 40 ] produced by NOF CORPORATION

Resistance to Ozone Test

Like Inventive Examples 1 and 2 and Comparative Example 1, a test piece (length: 60 mm, width: 10 mm, thickness: 2 mm) was prepared, and was exposed for 120 hrs to an environment with an ozone concentration of 10 ppm and with a temperature of 40° C. in a state being imparted with an elongation of 20%, to thereby evaluate the state of occurrence of cracks under the above evaluation standard.

Heat Test

The heat test was performed in accordance with an ageing test under JIS K6301. A dumbbell shaped test piece pattern No. 3 was heated at 120° C. for 72 hrs and subjected to tensile test. In this case, the heat resistance was evaluated on the basis of a retention of breaking elongation.

Retention of Breaking Elongation (EB)=(breaking elongation after heat test/breaking elongation before heat test)×100%

Next, a woven fabric made from polyester fibers was wound around a mandrel and a conductive rubber made from each rubber composition shown in Table 2 was laminated thereon, and then the conductive rubber was coated with a paint having the following composition to form a surface layer having a thickness of 50 μm, thus preparing an intermediate transfer belt. A volume resistivity of each intermediate transfer belt thus obtained was shown in Table 2.

| Composition of Paint | |
|---|---|
| polyurethane resin (1) | 30.0 g |
| tolylene diisocyanate | 0.2 g |
| powder of tetrafluoroethylene (2) | 3.0 g |
| toluene | 5.0 g |
| methyl ethyl keton | 50.0 g |

(1): [TI1500] produced by Sanyo Chemical Industries Ltd. (solid content: 30%).
(2): center particle size: 0.3 μm The intermediate transfer belt thus obtained was mounted as the intermediate transfer belt 20*b* on the intermediate transfer section of the image forming apparatus shown in FIG. 2, and was subjected to image forming test. In this test, an image of full color (four colors) formed and fixed on a paper sheet was visually observed, to thus evaluate the image quality on the basis of a reference (○: good, Δ: slightly poor, X : poor). The results are shown in Table 2.

The results in Table 2 show that when compared with each of the rubber compositions in Comparative Examples 2 to 4, each of the rubber compositions in Inventive Examples 3 to 5 exhibits a low volume resistivity irrespective of the same content of carbon black. As a result, it becomes apparent that each of the rubber compositions in Inventive Examples 3 to 5 is capable of adjusting the resistivity by addition of carbon black in a small amount, thereby controlling the resistivity at a desired value without increasing the hardness of the rubber composition.

Since the mixing ratio of EPDM/NBR is offset on the EPDM-rich side in the rubber material in each of Inventive Examples 3 to 5, it may be considered that the rubber material has a sea-island structure in which the EPDM is taken as the sea and the NBR is taken as islands, and consequently, the rubber composition is excellent in resistance to ozone and heat resistance as shown in Table 2. Thus, the intermediate transfer member of the present invention in which the rubber composition in each of Inventive Examples 3 to 5 is used as the conductive rubber exhibits a preferable image forming performance (intermediate transfer performance) for a long period. On the contrary, the rubber material in each Comparative Examples 2 to 4 is poor in resistance to ozone and heat resistance, and the intermediate transfer belt using such a rubber material gives the poor image quality because the resistivity of a semi-conductive rubber material is excessively high and thereby a voltage applied to the surface layer becomes smaller.

TABLE 2

| | Inventive Example | | | Comparative Example | | |
|---|---|---|---|---|---|---|
| | 3 | 4 | 5 | 2 | 3 | 4 |
| Rubber Composition | | | | | | |
| EPDM (*1) | 70 | 80 | 90 | 0 | 30 | 50 |
| NBR (*2) | 30 | 20 | 10 | 100 | 70 | 50 |
| carbon black (*3) | 30 | 30 | 30 | 30 | 30 | 30 |
| stearic acid | 1 | 1 | 1 | 1 | 1 | 1 |

TABLE 2-continued

| | Inventive Example | | | Comparative Example | | |
|---|---|---|---|---|---|---|
| | 3 | 4 | 5 | 2 | 3 | 4 |
| bridging agent (*4) | 5 | 5 | 5 | 5 | 5 | 5 |
| volume resistivity (Ω cm) | $3.9 \times 10^6$ | $2.8 \times 10^6$ | $8.8 \times 10^8$ | $4.5 \times 10^{10}$ | $5.5 \times 10^{10}$ | $2.3 \times 10^{10}$ |
| resistance to ozone | good (*A) | good (*A) | good (*A) | poor (*B) | poor (*C) | poor (*D) |
| heat resistance (EB retention %) | 88 | 90 | 90 | 43 | 55 | 62 |
| Intermediate Transfer Belt | | | | | | |
| volume resistivity (Ω cm) | $2.3 \times 10^{12}$ | $2.3 \times 10^{12}$ | $2.3 \times 10^{12}$ | $2.4 \times 10^{12}$ | $2.4 \times 10^{12}$ | $2.4 \times 10^{12}$ |
| judgement of image quality | ○ good | ○ good | ○ good | Δ color spread | Δ color spread | Δ color spread |

(*A) no change of test piece after 120 hrs (no crack)
(*B) breakage of test piece after 24 hrs (crack level: C-4)
(*C) breakage of test piece after 48 hrs (crack level: C-3)
(*D) breakage of test piece after 72 hrs (crack level: B-5)

[Inventive Examples 6 to 8 and Comparative Examples 5 and 6 ]

Components in each example shown in Table 3 were mixed at a mixing ratio shown in Table 3 and were kneaded by a kneader to prepare a rubber composition. The rubber composition thus obtained was set in a mold and subjected to bridging reaction at 160° C. for 30 min, to prepare a test piece for a compression set test in accordance with JIS K6301. Each test piece was also measured in terms of hardness by the type A hardness tester under JIS K6301, and was subjected to compression set test under a heat treatment condition of 70° C.×20 hrs in accordance with the same standard. Further, like Inventive Examples 1 to 5 and Comparative Examples 1 to 4, the test piece was subjected to the resistance to ozone test. The results are shown in Table 3.

Next, each rubber composition was injection-molded in a heated mold in which a cylindrical aluminum base was previously set, to form a conductive rubber layer having a thickness of about 5 mm around the outer periphery of the aluminum base, followed by bridging reaction. The aluminum base formed with the conductive rubber was released from the mold, and the outer peripheral surface of the conductive rubber layer was then coated with a paint having the following composition by spraying, followed by drying and hardening at 160° C. for 1 hr, to form a surface layer having a thickness of about 10 μm, thereby obtaining an intermediate transfer drum having the structure shown in FIG. 3.

| Composition of Paint | |
|---|---|
| Sefural Coat (1) | 167 parts by weight |
| Duranate E405-80T (2) | 86 |
| methyl ethyl keton | 335 |

1): produced by Central Glass Co., Ltd. (fluorocarbon resin containing hydroxyl group: 60%)
2): Asahi Chemical Co., Ltd. (solution containing 80% of polyisocyanate)

Each intermediate transfer drum thus obtained was mounted as the intermediate transfer member 20*a* on the intermediate transfer section of the image forming apparatus shown in FIG. 1, being left for three weeks, and was subjected to image forming test. In this test, an image quality of an image fixed on a paper sheet was visually observed. The results are shown in Table 3.

From the results shown in Table 3, it is confirmed that the intermediate transfer drum in each of Inventive Examples 6 to 8, which includes the conductive rubber layer made from the rubber composition having a compression set under JIS K6301 in a range of 20% or less and a hardness measured by the type A hardness tester under JIS K6301 in a range of 70 to 25 scale, prevents a defective linear image liable to occur after being left in a non-operational state for a long period, to thereby certainly obtain a preferable image. Further, reference numerals (*1) to (*8) added to the components in Table 3 are as follows:

TABLE 3

| | Inventive Example | | | Comparative Example | |
|---|---|---|---|---|---|
| | 6 | 7 | 8 | 5 | 6 |
| Conductive Rubber Composition (parts by weight) | | | | | |
| epichlorohidrin rubber (*1) | 60 | 50 | 80 | 80 | |
| epichlorohidrin rubber (*2) | | | | | 40 |
| NBR (*3) | 20 | 20 | 20 | | 30 |
| Liquid NBR (*4) | 20 | 30 | | 20 | 20 |
| carbon black | 5 | 30 | 20 | 15 | 20 |
| calcium carbonate | 20 | 10 | 20 | 20 | 20 |
| magnesia | 3 | 3 | 3 | 3 | 3 |
| zinc stearate | 1 | 1 | 3 | 1 | 1 |
| bridging agent (*5) | 3 | 3 | | | 3 |
| bridging agent (*6) | | | 3 | | |
| bridging agent (*7) | | | | 0.9 | |
| accelerator (*8) | | | | 0.3 | |
| Volume Resistivity (Ω cm) | $4.0 \times 10^8$ | $5.1 \times 10^8$ | $4.1 \times 10^8$ | $1.1 \times 10^8$ | $2.1 \times 10^8$ |
| Evaluation by Resistance to Ozone Test | no crack | no crack | no crack | B-5 | C-3 |
| JIS-A Hardness (scale) | 37 | 40 | 63 | 33 | 36 |
| Compression Set CS (%) | 9.5 | 10.7 | 14.1 | 28.8 | 34.3 |
| Intermediate Transfer Drum | | | | | |
| Volume Resistivity (Ω cm) | $6.2 \times 10^{10}$ | $6.3 \times 10^{10}$ | $6.2 \times 10^{10}$ | $6.2 \times 10^{10}$ | $6.2 \times 10^{10}$ |
| Image Test | good | good | good | (*A) | (*A) |

(*A): horizontal line due to contact with photosensitive body
(*1): [Epichloma CG] produced by DAISO CO., LTD.
(*2): [Epichloma D] produced by DAISO CO., LTD.
(*3): [N230SV] produced by Japan Synthetic Rubber Co., Ltd.
(*4): [N280] produced by Japan Synthetic Rubber Co., Ltd.
(*5): [Partible P-40] produced by NOF CORPORATION
(*6): [Perkmill D-40] produced by NOF CORPORATION
(*7): [Jisnet F] produced by Sankyo Kasei Co., Ltd.
(*8): [Vulcanization Accelerator TS] produced by Sanshin Chemical Industries Co., Ltd.

Next, there will be described Inventive Examples 9 to 19 and Comparative Examples 7 to 10 according to the second invention.

[Inventive Example 9]

A woven fabric made from polyester fibers was wound around a mandrel, and a rubber composition of a mixed rubber of a nitrile rubber and an ethylene-propylene rubber added with carbon for adjusting a resistivity was laminated thereon, followed by vulcanization-molding, to prepare an endless rubber belt (width: 240 mm, peripheral length: 450 mm, thickness: 1 mm). For the rubber belt, the hardness measured by the type A hardness tester under JIS K6301 was 40 scale and the volume resistivity was $10^{6.0}$ Ω cm.

A paint having the following composition was then prepared using a polyester based polyurethane resin containing phthalic acid ([TI1500] produced by Sanyo Chemical Industries Ltd., glass transition temperature: 13° C., volume resistivity: $10^{13.7}$ Ω cm, solid content: 30%). The rubber belt was coated with the paint by spraying to form a surface layer having a thickness of about 50 μm, followed by drying and hardening at 120° C. for 1 hr, thus preparing a belt-like intermediate transfer member.

| Composition of Paint | |
|---|---|
| TI1500 | 30.0 g |
| tolylene diisocyanate (TDI) | 0.20 g |
| powder of polytetrafluoroethylene (PTFE)* | 3.0 g |
| toluene (TL) | 5.0 g |
| methyl ethyl keton (MEK) | 50.0 g |

* center particle size: 0.3 μm

[Inventive Example 10]

The same procedure as that in Inventive Example 9 was repeated except that a paint having the following composition was prepared using a polyester based polyurethane resin containing phthalic acid ([Nippolan 3124 produced by Nippon Polyurethane Industry Co., Ltd., glass transition temperature: −7° C., volume resistivity: $10^{14.6}$ Ω cm, solid content: 50%) and a surface layer was formed using the paint, to prepare a belt-like intermediate transfer belt.

| Composition of Paint | |
|---|---|
| Nippolan 3124 | 30.0 g |
| TDI | 0.42 g |
| powder of PTFE | 15.0 g |
| TL | 23.0 g |
| MEK | 25.0 g |

[Comparative Example 7]

The same procedure as that in Inventive Example 9 was repeated except that a paint having the following composition was prepared using a polyester based polyurethane resin having a high glass transition temperature ([Nippolan 3125 produced by Nippon Polyurethane Industry Co., Ltd., glass transition temperature: 39° C., volume resistivity: $10^{14.0}$ Ω cm, solid content: 20%) and a surface layer was formed using the paint, to prepare a belt-like intermediate transfer belt.

| Composition of Paint | |
|---|---|
| Nippolan 3125 | 75.0 g |
| TDI | 0.42 g |
| powder of PTFE | 15.0 g |
| TL | 23.0 g |

[Comparative Example 8]

The same procedure as that in Inventive Example 9 was repeated except that a paint having the following composition was prepared using a polyester based polyurethane resin having a low glass transition temperature ([Nippolan 3126 produced by Nippon Polyurethane Industry Co., Ltd., glass transition temperature: −40° C., volume resistivity: $10^{12.8}$ Ω cm, solid content: 53%), and a surface layer was formed using the paint, to prepare a belt-like intermediate transfer belt.

| Composition of Paint | |
|---|---|
| Nippolan 3126 | 30.0 g |
| TDI | 0.42 g |

-continued

| Composition of Paint | |
|---|---|
| powder of PTFE | 15.0 g |
| TL | 23.0 g |
| MEK | 25.0 g |

Each intermediate transfer member was subjected to the following tests. The results are shown in Table 4.

Photosensitive Body Contamination Test

A photosensitive drum was pressed on a belt by applying a load of 500 g to each of both end portions of the photosensitive drum, being left for three weeks, and the belt was peeled. Then, the contamination state on the surface of the photosensitive drum was observed.

Toner Adhesion Test

Toner was scattered on the belt and then wiped off using cotton paper. Then, a remaining state of the toner on the belt was observed.

Friction Test

The maximum friction coefficient of the belt with respect to a photosensitive film with a load of 50 g applied therebetween using a Hayden type surface tester.

Belt Bending Test

A test piece (width: 20 mm, length: 350 mm) was cut out from each belt, and was set on a pulley having a diameter of 16 mm. The test piece was repeatedly moved up and down at a speed of 30 rpm in a state in which a load was applied on each of both ends of the test piece to produce a tension of 1 kg/1 mm. Then, after repeating the movement a specific number, the surface of the test piece was observed.

As shown in Table 4, the intermediate transfer member in each of Inventive Examples 9 and 10 has the resistivity adjusted in a medium resistance region by the surface layer, being excellent in photosensitive body contamination characteristic, tone adhesion characteristic and friction characteristic, and is significantly excellent in a durability against bending. On the contrary, the intermediate transfer member in Comparative Example 7 in which the surface layer is made from the polyester based polyurethane resin having a high glass transition temperature is poor in durability in a belt bending test because the surface layer is hard and brittle; while the intermediate transfer member in Comparative Example 8 in which the surface layer is made from the polyester based polyurethane resin having a low glass transition temperature is poor in photosensitive body contamination characteristic and toner adhesion characteristic, and also it is larger in friction coefficient.

TABLE 4

| | Inventive Example | | Comparative Example | |
|---|---|---|---|---|
| | 9 | 10 | 7 | 8 |
| glass transition temp. (° C.) of urethane resin | 13 | −7 | 39 | −40 |
| resistivity before coating (Ωcm) | $10^{6.0}$ | $10^{6.0}$ | $10^{6.0}$ | $10^{6.0}$ |
| resistivity after coating (Ωcm) | $10^{12.4}$ | $10^{13.3}$ | $10^{12.6}$ | $10^{11.5}$ |
| photosensitive body contamination test (degree of contamination) | absence | absence | absence | presence (slight) |
| toner adhesion test (degree of adhesion) | absence | absence | presence (slight) | presence (significant) |
| friction coefficient | 0.4 | 0.5 | 0.6 | 1.1 |
| belt bending test | (*A) | (*A) | (*B) | (*A) |

(*A) no occurrence of cracks after repeating 10,000 times
(*B) occurrence of cracks in surface after repeating 100 times

[Inventive Example 11]

The same procedure as that in Inventive Example 9 was repeated except that a paint having the following composition was prepared using a hydrogenated polyisoprenepolyol ([Epol] produced by Idemitsu Petrochemical Co., Ltd.) as a polyolefin based urethane resin and an isophoronediisocyanate ([Takenate D140N] produced by Takeda Chemical Industries, Ltd.) as a polyisocyanate, and a surface layer having a thickness of about 5 μm was formed on the above rubber belt using the paint by spraying, to prepare a belt-like intermediate transfer belt.

| Composition of Paint | |
|---|---|
| Epol | 20.0 g |
| Takenate D140N | 7.5 g |
| powder of PTFE* | 10.0 g |
| Toluene (TL) | 50.0 g |

*central particle size: 0.3 μm

[Inventive Example 12]

The same procedure as that in Inventive Example 11 was repeated except that a paint having the following composition was prepared using a hydrogenated 1,2 polybutadienepolyol ([Polytale HA] produced by Mitsubishi Chemical Corporation) as a polyolefin based urethane resin and a hexamethylene-diisocyanate modified material ([E405-80T] produced by Asahi Chemical Co. Ltd.) and an isophorone-diisocyanate ([Takenate D140N] produced by Takeda Chemical Industries. Ltd.) as polyisocyanates, and a surface layer was formed using the paint, to prepare a belt-like intermediate transfer belt.

| Composition of Paint | |
|---|---|
| Polytale | 15.0 g |
| E405-80T | 3.5 g |
| Takenate D140N | 3.7 g |
| powder of PTFE | 10.0 g |
| TL | 65.0 g |

[Comparative Example 9]

The same procedure as that in Inventive Example 11 was repeated except that a paint having the following composition was prepared using a polyester based urethane resin ([Nippolan 3126] produced by Nippon Polyurethane Industry Co., Ltd) in place of the polyolefin based polyurethane resin and a tolylenediisocyanate (TDI) as a polyisocyanate, and a surface layer was formed using the paint, to prepare a belt-like intermediate transfer belt.

| Composition of Paint | |
|---|---|
| Nippolan 3126 (*1) | 30.0 g |
| TDI | 0.4 g |

-continued

| Composition of Paint | |
|---|---|
| powder of PTFE | 15.0 g |
| TL | 23.0 g |
| methyl ethyl keton | 25.0 g |

(*1) resin concentration: 53%, glass transition temperature: −40° C., volume resistivity: $10^{12.8}$ Ωcm Each of the intermediate transfer members in Inventive Examples 11 and 12 and Comparative Example 9 was evaluated in terms of resistivity adjustability and environment dependence, and also subjected to the above-described photosensitive body contamination test, toner adhesion test, friction coefficient test and belt bending test in the same manner as described above. The results are shown in Table 5.

Resistivity Adjustability

A volume resistivity after formation of the surface layer is measured, to examine whether or not the volume resistivity ($1.0\times10^6$ Ω cm) before formation of the surface layer is in a range of $10^{12}$ to $10^{14}$ Ω cm after formation of the surface layer.

Environment Dependency

A volume resistivity of a belt left for two days in each of a L/L condition (temperature of 15° C./humidity of 10%) and a H/H condition (temperature of 32.5° C./humidity of 85%) was measured, to calculate a difference (number of figure) between the volume resistivities in the L/L and H/H conditions.

As shown in Table 5, it is confirmed that the intermediate transfer member in each of Inventive Examples 11 and 12 has the resistivity adjusted in a medium resistivity range by provision of the surface layer and is also excellent in environment dependency, photosensitive body contamination characteristic, toner adhesion characteristic, friction characteristic, and durability against bending. On the contrary, with respect to the intermediate transfer member in Comparative Example 9 in which the surface layer was made from the polyester based polyurethane resin having a low glass transition temperature, it is confirmed that the durability against bending is excellent but the environment dependency, photosensitive body contamination characteristic and toner adhesion characteristic are poor and also the friction coefficient is larger.

TABLE 5

| | Inventive Example | | Comparative Example |
|---|---|---|---|
| | 11 | 12 | 9 |
| Volume Resistivity of Resin (Ω cm) | $2.5 \times 10^{16}$ | $1.0 \times 10^{16}$ | $6.3 \times 10^{12}$ |
| Resistivity Adjustability | | | |
| resistivity before coating (Ω cm) | $1.0 \times 10^{6}$ | $1.0 \times 10^{6}$ | $1.0 \times 10^{6}$ |
| resistivity after coating (Ω cm) | $1.3 \times 10^{13}$ | $5.0 \times 10^{12}$ | $3.1 \times 10^{10}$ |
| Environment Dependency on Resistivity | | | |
| resistivity in L/L (Ω cm) | $1.0 \times 10^{13}$ | $5.0 \times 10^{12}$ | $5.9 \times 10^{10}$ |
| resistivity in H/H (Ω cm) | $3.2 \times 10^{11}$ | $4.0 \times 10^{11}$ | $1.8 \times 10^{8}$ |
| variation in resistivity between L/L and H/H (number of figure) | 1.5 | 1.2 | 2.5 |
| Photosensitive Body Contamination Test (degree of contami.) | absence | absence | presence (slight) |
| Toner Adhesion Test (degree of adhesion) | absence | absence | presence |
| friction coefficient | 0.6 | 0.7 | 1.1 |
| belt bending test | (*A) | (*A) | (*A) |

(*A) no occurrence of cracks after repeating 30,000 times

[Inventive Examples 13 to 15]

A paint having a composition shown in each example of Table 6 was prepared using a hydrogenated 1,2-polybutadiene-polyol ([G1-1000] produced by Mitsubishi Chemical Corporation) as a polyolefin based polyol and a TMP-adduct material of IPDI ([Takenate D140N] produced by Takeda Chemical Industries, Ltd.) and a caprolactam-adduct material of HDI ([E405-80T] produced by Asahi Chemical Co., Ltd.) as polyisocyanate compounds. Using the paint, a film having a thickness of about 30 μm was formed by spraying on the rubber belt obtained in the same manner as that in Inventive Example 9, followed by drying and hardening at 120° C. for 1 hr to form a surface layer, thus preparing an intermediate transfer belt.

[Comparative Example 10]

The same procedure as that in each of Inventive Example 13 to 15 was repeated except that a paint having a composition shown in Table 6 was prepared using a polyester based polyurethane polyol ([Nippolan 3126] produced by Japan Polyurethane Industry Co., Ltd., glass transition temperature: −40° C.) in place of the polyolefin based polyurethane resin and using TDI as a polyisocyanate, and a surface layer was formed using the paint, to prepare an intermediate transfer belt.

Each of the intermediate transfer members in Inventive Examples 13 to 15 and Comparative Example 10 was evaluated in the same manner as described in terms of resistivity adjustability and environment dependence on resistivity, and also subjected to the above-described photosensitive body contamination test, toner adhesion test, friction coefficient test and belt bending test. The results are shown in Table 6.

As shown in Table 6, it is confirmed that the intermediate transfer member in each of Inventive Examples 13 to 15 using the polyolefin based polyol in combination with the two kinds of the polyisocyanate compounds is excellent in resistivity adjustability, environment dependency on resistivity, photosensitive body contamination characteristic, toner adhesion characteristic, friction characteristic, and durability against bending.

TABLE 6

| Composition of Paint | Inventive Example | | Example | Comparative |
|---|---|---|---|---|
| (parts by weight) | 13 | 14 | 15 | 10 |
| GI-1000 | 15.0 | 15.0 | 15.0 | |
| Nippolan 3126(*2) | 30.0 | | | |
| E405-80T(*3) | 2.59 | 4.72 | 7.31 | |
| TDI | 0.4 | | | |
| Di40N(*4) | 6.44 | 5.04 | 3.34 | |
| powder of PTFE(*1) | 20.4 | 21.4 | 21.4 | 15.0 |
| toluene | 65.0 | 65.0 | 65.0 | 23.0 |
| methyl ethyl keton | | | | 25.0 |
| [ratio in solid content between E405-80T/D140N] | 3/7 | 5/5 | 7/3 | |
| Volume Resistivity of Coating Film (Ω cm) | $2.0 \times 10^{15}$ | $7.9 \times 10^{14}$ | $4.3 \times 10^{12}$ | $2.8 \times 10^{14}$ |
| Resistivity Adjustability resistivity before coating (Ω cm) | $1.0 \times 10^{6}$ | $1.0 \times 10^{6}$ | $1.0 \times 10^{6}$ | $1.0 \times 10^{6}$ |
| resistivity after coating (Ω cm) | $5.8 \times 10^{13}$ | $2.3 \times 10^{13}$ | $1.3 \times 10^{13}$ | $1.8 \times 10^{11}$ |
| Environment Dependence on Resistivity | | | | |
| resistivity in L/L Ω cm) | $6.1 \times 10^{13}$ | $2.3 \times 10^{13}$ | $1.3 \times 10^{13}$ | $3.5 \times 10^{11}$ |
| resistivity in H/H (Ω cm) | $2.6 \times 10^{13}$ | $1.8 \times 10^{12}$ | $6.7 \times 10^{11}$ | $1.1 \times 10^{9}$ |
| variation in resistivity between L/L and H/H (number of figure) | 0.4 | 1.1 | 1.3 | 2.5 |
| photosensitive body contamination test | absence | absence | absence | presence (slight) |
| toner adhesion test | absence | absence | absence | presence |
| friction coefficient | 0.6 | 0.7 | 0.9 | 1.1 |
| belt bending test | (*A) | (*A) | (*A) | (*A) |

*1): central particle size: 0.3 μm
*2): solid content: 53%
*3): solid content: 80%
*4): solid content: 75%
(*A) no occurrence of cracks after repeating 30,000 times

[Inventive Example 16]

A paint having the following composition was prepared using a polyester based monoliquid solvent-drying/solidifying type urethane ([Nippolan 3124] produced by Japan Polyurethane Industry Co., Ltd., glass transition temperature: −7° C., volume resistivity: $10^{14.6}$ Ω cm, solid content: 50 wt %) as a main component of a urethane resin, an isophoronediisocyanate modified material ([Takenate D140N] produced by Takeda Chemical Co., Ltd.; solid content: 75 wt %) as an alicyclic polyisocyanate hardening agent, and a powder of PTFE (polytetrafluoroethylene, central particle size of 0.3 μm) as an additive. Using the paint, a surface layer (urethane resin coating film layer) having a thickness of about 40 μm was formed by spraying on a rubber belt obtained in the same manner as that in Inventive Example 9, followed by hardening and hardening at 140° C. for 30 min, thus preparing an intermediate transfer belt. Further, the above paint was poured in a mold, followed by drying and hardening at 140° C. for 30 min, to prepare a resin sheet sample.

| Composition of Paint | |
|---|---|
| Nippolan 3124 | 25.0 g |
| Takenate D140N | 5.0 g |
| powder of polytetrafluoroethylene (PTFE) | 5.0 g |
| methyl ethyl keton (MEK) | 55.0 g |

[Inventive Example 17]

The same procedure as that in Inventive Example 16 was repeated except that a paint having the following composition was prepared using a hexamethylenediisocyanate modified material ([Duranate 22A-75PX] produced by Asahi Chemical Co., Ltd., solid content: 75 wt %) as an aliphatic isocyanate type hardening agent, and a surface layer was formed using the paint, to prepare a belt-like intermediate transfer belt and a resin sheet sample.

| Composition of Paint | |
|---|---|
| Nippolan 3124 | 25.0 g |
| Duranate 22A-75PX | 5.0 g |
| powder of PTFE | 5.0 g |
| MEK | 55.0 g |

[Inventive Example 18]

The same procedure as that in Inventive Example 16 was repeated except that a paint having the following composition was prepared using a polyolefin based polyol ([G1-2000] produced by Nippon Soda Co., Ltd. as a main component of a urethane resin and toluene was used as a paint solvent, and a surface layer was formed using the paint, to prepare a belt-like intermediate transfer belt and a resin sheet sample.

| Composition of Paint | |
|---|---|
| GI-2000 | 15.0 g |
| Takenate D140N | 7.0 g |
| powder of PTFE | 5.0 g |
| toluene | 65.0 g |

[Inventive Example 19]

The same procedure as that in Inventive Example 16 was repeated except that a paint having the following composition was prepared using a polyolefin based polyol ([Epol] produced by Idemitsu Petrochemical Co., Ltd.) as a main component of a urethane resin; a hexamethylenediisocyanate modified material ([Sumijul N-3500] produced by Sumitomo Bayer Urethane Co., Ltd.) as an aliphatic isocyanate type hardening agent and toluene was used as a paint solvent, and a surface layer was formed using the paint, to prepare a belt-like intermediate transfer belt and a resin sheet sample.

| Composition of Paint | |
|---|---|
| Epo1 | 15.0 g |
| Sumijul N-3500 | 3.0 g |
| powder of PTFE | 5.0 g |
| toluene | 65.0 g |

The resin sheet sample and the intermediate transfer member in each of Inventive Examples 16 to 19 were subjected to the following ozone exposure test and image forming test. The results are shown in Table 7.

Ozone Exposure Test

Each resin sheet sample was exposed to ozone for 120 hrs in a test chamber with an ozone concentration of 10 ppm and a temperature of 35° C., and a variation in volume resistivity before and after exposure to ozone and a number of figure of the variation in volume resistivity was calculated on the basis of the following equation:

number of figure=log {(volume resistivity after test)/(volume resistivity before test)}

Image Forming Test

The above intermediate transfer belt was mounted in a full color printer having the same configuration as that of the image forming apparatus shown in FIG. 2, and an initial image and an image obtained after printing 10,000 sheets were evaluated. The conditions of the image forming test using the above printer are as follows:

Conditions of Printer photosensitive potential: −550 V
toner: non-magnetic one component toner
primary transfer voltage: +500 V
secondary transfer voltage: +1500 V
development potential: −400 V
processing velocity: 120 mm/sec As shown in Table 7, it is confirmed that the intermediate transfer member (intermediate transfer belt) in each of Inventive Examples 16 to 19 in which a variation in resistivity due to exposure to ozone is 0.5 figure or less is capable of stably obtaining a preferably image after used for a long period. In addition, for such an intermediate transfer belt, occurrence of cracks and adhesion of toner in and on the surface are little observed even after printing 10,000 sheets.

TABLE 7

| | Inventive Example | | | |
|---|---|---|---|---|
| | 16 | 17 | 18 | 19 |
| volume resistivity of resin sheet (Ω cm) | $1.0 \times 10^{15}$ | $8.0 \times 10^{14}$ | $3.2 \times 10^{15}$ | $1.6 \times 10^{15}$ |
| volume resistivity of resin sheet after ozone exposure test (Ω cm) | $7.9 \times 10^{14}$ | $4.0 \times 10^{14}$ | $2.5 \times 10^{15}$ | $1.3 \times 10^{15}$ |
| variation in volume resistivity before and after ozone exposure test (number of figure) | −0.1 | −0.3 | −0.1 | −0.1 |
| initial image test | good | good | good | good |
| image test after printing 10,000 sheets | good | good | good | good |

Next, there will be described Inventive Examples 20 to 23 and Comparative Examples 11 and 12 according to the third invention.

[Inventive Examples 20 to 23 and Comparative Examples 11 and 12]

A woven fabric of polyester fibers was wound around a mandrel and a conductive rubber layer made from a rubber composition shown in each example of Table 8 was laminated thereon, and a coating film made from a resin shown in the corresponding example of Table 8 was formed thereon to form a surface layer, thus preparing an intermediate transfer belt. In addition, each content in Table 8 is expressed in parts by weight.

For each intermediate transfer belt, a dielectric constant $\epsilon$ b of the conductive rubber layer and a volume resistivity ρ vs of the surface layer were measured in accordance with the following methods. The results are shown in Table 8, and a relationship between the dielectric constant $\epsilon$ b and the volume resistivity p vs for each belt was plotted in FIG. 9.

Measurement of Dielectric Constant $\epsilon$ b (1) measurement environment: 20° C., relative humidity: 50%

(2) measurement voltage: 10 mV to 1 V (3) measurement apparatus: Impedance Analyzer A4194A produced by HEWLETT-PACKARD COMPANY Measurement of Volume Resistivity ρ vs (1) measurement environment: 20° C., relative humidity: 50%

(2) measurement voltage: 1,000 V (3) measurement apparatus: Resistance Meter R8340A connected to Sample Chamber TR42 both produced by ADVANTEST CORP.

Each intermediate transfer belt was mounted on the intermediate transfer apparatus shown in FIG. 2, and subjected to toner image transfer testing. The results are shown in Table 8.

As shown in Table 8, it is confirmed that the intermediate transfer belt in each of Inventive Examples 20 to 23, which is formed of the laminated body specified in the relationship between the dielectric constant of the conductive rubber layer and the volume resistivity of the surface layer, exhibits a sufficient toner retention force to certainly perform an intermediate transfer operation of an toner image.

TABLE 8

| | Inventive Example | | | | Comparative Example | |
|---|---|---|---|---|---|---|
| | 20 | 21 | 22 | 23 | 11 | 12 |
| Composition of Elastic Layer | | | | | | |
| N230SV(*1) | 20 | 20 | 20 | 20 | 20 | 20 |
| Liq-NBR(*2) | 20 | 20 | 20 | 20 | 20 | 20 |
| EP-33(*3) | 60 | 60 | 60 | 60 | 60 | 60 |
| C/BG-SVH(*4) | 100 | 100 | 15 | 15 | 25 | 35 |
| stearic acid | 1 | 1 | 1 | 1 | 1 | 1 |
| Partible P-40(*5) | 5 | 5 | 5 | 5 | 5 | 5 |
| Dielectric Constant of Elastic Layer (log ϵ b) | 4.6 | 4.6 | 0.95 | 0.95 | 2.0 | 3.6 |
| Resin of Coating Layer | PML-3005 (*6) | GI-3000 (*7) | Samplene IB114 (*8) | TH-1 (*9) | PML-3005 (*6) | TH-1 (*9) |
| Volume Resistivity of Coating Layer (log ρ vs) Ω cm | 10.5 | 15.9 | 12.4 | 17.3 | 10.5 | 17.3 |
| Result of Transfer Test | (*A) | (*A) | (*A) | (*A) | (*B) | (*C) |

(*1) acrylonitrile-butadiene (Japan Synthetic Rubber Co., Ltd.)
(*2) liquid acrylonitrile-butadiene (Nippon Zeon Co., Ltd.)
(*3) ethylene-propylene rubber (Japan Synthetic Rubber Co., Ltd.)
(*4) carbon black (Tokai Carbon Co., Ltd.)
(*5) organic peroxide (NOF CORPORATION)
(*6) polyurethanepolyol (ether type) (Asahi Glass Co., Ltd.)
(*7) polyurethanepolyol (hydrogenated polybutadiene) (Nippon Soda Co., Ltd.)
(*8) polyurethanepolyol (ester type) (Sanyo Chemical Industries, Ltd.)
(*9) polyurethanepolyol (hydrogenated polyisoprene) (Kuraray Co., Ltd.)
*A) toner image to be transferred on recording medium
*B) toner image not to be transferred on intermediate transfer belt
*C) toner image not to be transferred on recording medium

We claim:

1. An intermediate transfer member disposed between an image forming body and a recording medium, for transferring and holding a toner image formed on a surface of said image forming body onto a surface of said intermediate transfer member once and then transferring the toner image onto said recording medium, said intermediate transfer member comprising:

a rubber composition, wherein the state of occurrence of cracks in said rubber composition after said rubber composition imparted with 20% of elongation has been exposed for 120 hours to an environment with an ozone concentration of 10 ppm and with a temperature of 40° C. is specified such that no crack is seen, or the number of cracks is at a rank A or B and the size and depth of cracks are at any one of ranks 1 to 4 under the following evaluation standard in accordance with Japanese Industrial Standard (JIS) K6301.

2. An intermediate transfer member according to claim 1, wherein 30 wt % or more of a rubber component constituting said rubber composition is a rubber which does not contain a double bond at a main chain.

3. An intermediate transfer member according to claim 2, wherein said rubber not containing a double bond at a main chain is one kind or two kinds or more selected from a group consisting of an ethylene-propylene rubber, ethylene-propylene-diene rubber, epichlorohydrin rubber, acrylic rubber and silicon rubber.

4. An intermediate transfer member according to claim 3, wherein said rubber composition mainly contains a rubber mixture in which an ethylene-propylene rubber (EPDM) and an acrylonitrile-butadiene rubber (NBR) are mixed at a mixing ratio by weight of EPDM/NBR=90/10 to 55/45, and said rubber composition is added with carbon black having a nitrogen absorption specific surface area in a range of 20 to 150 $m^2/g$ and a dibutvlphthalate (DPB) oil absorption amount in a range of 60 to 180 ml/100 g, thereby adjusting a volume resistivity of said rubber composition.

5. An intermediate transfer member according to claim 1, wherein a compression set of said rubber composition measured under JIS K6301 is in a range of 20% or less, and a hardness of said rubber composition measured by a type A hardness tester under JIS K6301 is in a range of 70 to 25 scale.

6. An intermediate transfer member according to claim 1, wherein a volume resistivity of said rubber composition is adjusted in a range of $10^4$ to $10^9$ Ω cm by addition of carbon black.

7. An intermediate transfer member according to claim 1, comprising a conductive rubber layer made from said rubber composition, and a surface layer formed on said conductive rubber layer.

8. An intermediate transfer member according to claim 7, wherein a volume resistivity of said member is adjusted in a range of $10^8$ to $10^{14}$ Ω cm by provision of said surface layer.

9. An intermediate transfer member according to claim 7, said surface layer is mainly made from a urethane resin or a fluorocarbon resin.

10. An intermediate transfer member according to claim 1, wherein said member is formed into a belt-like or a drum-like shape.

11. An intermediate transfer apparatus comprising:

an intermediate transfer member disposed between an image forming body and a recording medium, for transferring and holding a toner image formed on a surface of said image forming body onto a surface of said intermediate transfer member once and then transferring the toner image onto said recording medium; and a voltage applying means for applying a voltage to said intermediate transfer member;

wherein said intermediate transfer member described in claim 1 is used as said intermediate transfer member of said intermediate transfer apparatus.

12. An intermediate transfer member disposed between an image forming body and a recording medium, for transferring and holding a toner image formed on a surface of said image forming body onto a surface of said intermediate transfer member once and then transferring the toner image onto said recording medium, said intermediate transfer member comprising:

a conductive rubber layer; and a surface layer formed on a surface of said conductive rubber layer;

wherein said surface layer is mainly made from a polyester based polyurethane resin having a glass-transition temperature in a range of −20 to 20° C.

13. An intermediate transfer member according to claim 12, wherein a volume resistivity of said polyester based polyurethane resin constituting said surface layer is in a range of $10^{13}$ to $10^{16}$ Ω cm, and said surface layer does not contain any conductive agent.

14. An intermediate transfer member according to claim 12, wherein said polyester based polyurethane resin contains phthalic acid and/or isophthalic acid.

15. An intermediate transfer member according to claim 12, wherein said surface layer comprises a resin layer, said resin layer exhibiting a variation in electric resistance in a range of a number of 0.5 figure or less when said resin layer is exposed for 120 hours to ozone at an ozone concentration of 10 ppm and at a temperature of 35° C.

16. An intermediate transfer member according to claim 15, wherein said polyester based polyurethane resin uses, as a hardening agent, at least one hardening agent selected from a group consisting of an aliphatic polyisocyanate compound, an alicyclic polyisocyanate compound, and a hydrogenated aromatic polyisocyanate compound.

17. An intermediate transfer member according to claim 16, wherein said hardening agent comprises a modified hexamethylenediisocyanate or a modified isophoronediisocyanate.

18. An intermediate transfer member according to claim 15, wherein said surface layer is mainly made from a polyester based polyurethane resin, said polyurethane resin mainly containing a polyester/polyol using, as a hardening agent, at least one hardening agent selected from a group consisting of an aliphatic isocyanate, an alicyclic isocyanate and derivatives thereof.

19. An intermediate transfer member according to claim 12, wherein said conductive rubber layer is mainly made from a rubber selected from the group consisting of an ethylene-propylene rubber, an ethylene-propylene-diene rubber, and a blend rubber of said ethylene-propylene rubber or said ethylene-propylene-diene rubber with another rubber.

20. An intermediate transfer member according to claim 12, wherein said intermediate transfer member is formed into a belt-like or a drum-like shape.

21. An intermediate transfer apparatus comprising:

an intermediate transfer member disposed between an image forming body and a recording medium, for transferring and holding a toner image formed on a surface of said image forming body onto a surface of said intermediate transfer member once and then transferring the toner image onto said recording medium; and a voltage applying means for applying a voltage to said intermediate transfer member;

wherein said intermediate transfer member described in claim 12 is used as said intermediate transfer member of said intermediate transfer apparatus.

22. An intermediate transfer member disposed between an image forming body and a recording medium, for transferring and holding a toner image formed on a surface of said intermediate transfer member once and then transferring the toner image onto said recording medium, said intermediate transfer member comprising:

a conductive rubber layer, and a surface layer formed on a surface of said conductive rubber layer;

wherein said surface layer is made from a polyolefin based polyurethane resin, said polyurethane resin mainly containing a polyolefin based polyol with two or more polyisocyanate compounds used as a hardening agent to adjust a volume resistivity thereof in a range of $10^{13}$ to $10^{16}$ Ω cm, or said surface layer is made from a composition containing said polyurethane resin.

23. An intermediate transfer member according to claim 22, wherein of said polyisocyanate compounds, at least one kind is a polyisocyanate selected from a group consisting of an aliphatic isocyanate, an alicyclic isocyanate, and derivatives thereof.

24. An intermediate transfer member according to claim 22, wherein of said polyisocyanate compounds, at least one kind is a polyisocyanate selected from a group consisting of a hexamethylenediisocyanate, an isophoronediisocyanate, and derivatives thereof.

25. An intermediate transfer member according to claim 22, wherein said surface layer does not contain any conductive agent.

26. An intermediate transfer member according to claim 22, wherein said polyolefin based polyurethane resin contains phthalic acid and/or isophthalic acid.

27. An intermediate transfer member according to claim 26, wherein said polyolefin based polyurethane resin uses, as a hardening agent, at least one hardening agent selected from a group consisting of an aliphatic polyisocyanate compound, an alicyclic polyisocyanate compound, and a hydrogenated aromatic polyisocyanate compound.

28. An intermediate transfer member according to claim 26, wherein said surface layer is mainly made from a polyolefin based polyurethane resin, said polyurethane resin mainly containing a polyester/polyol using, as a hardening agent, at least one hardening agent selected from a group consisting of an aliphatic isocyanate, an alicyclic isocyanate and derivatives thereof.

29. An intermediate member according to claim 22, wherein said surface layer comprises a resin layer, said resin layer exhibiting a variation in electric resistance in a range of a number of 0.5 figure or less when said resin layer is exposed for 120 hours to ozone at an ozone concentration of 10 ppm and at a temperature of 35° C.

30. An intermediate transfer member according to claim 29, wherein said hardening agent comprises a modified hexamethylenediisocyanate or a modified isophoronediisocyanate.

31. An intermediate transfer member according to claim 22, wherein said conductive rubber layer is mainly made from a rubber selected from the group consisting of an ethylene-propylene rubber, an ethylene-propylene-diene rubber, and a blend rubber of said ethylene-propylene rubber or said ethylene-propylene-diene rubber with another rubber.

32. An intermediate transfer member according to claim 22, wherein said intermediate transfer member is formed onto a belt-like or a drum-like shape.

33. An intermediate transfer member comprising:

a laminated body including one or more of conductive rubber layers, and one or more of coated layers;

wherein said laminated body satisfies the following conditions (1) and (2):

(1) $0 < \log \epsilon b \leqq 6$ (2) $-2 \log \rho vs + 24 \leqq \log \epsilon b \leqq -3 \log \rho vs + 54$ where $\epsilon b$ is a dielectric constant of said conductive rubber layer and $\rho vs$ is a volume resistivity of said surface layer.

34. An intermediate transfer member according to claim 33, wherein said member is formed into a belt-like or a drum-like shape.

35. An intermediate transfer apparatus comprising:

an intermediate transfer member disposed between an image forming body and a recording medium, for transferring and holding a toner image formed on a surface of said image forming body onto a surface of said intermediate transfer member once and then transferring the toner image onto said recording medium; and a voltage applying means for applying a voltage to said intermediate transfer member;

wherein said intermediate transfer member described in claim 33 is used as said intermediate transfer member of said intermediate transfer apparatus.

* * * * *